US008086125B2

(12) United States Patent
Koido

(10) Patent No.: US 8,086,125 B2
(45) Date of Patent: Dec. 27, 2011

(54) IMAGE FORMING APPARATUS THAT INCLUDES A FIRST DEVELOPING DEVICE THAT HOLDS A BLACK DEVELOPER AND A SECOND DEVELOPING DEVICE THAT HOLDS A GRAY DEVELOPER

(75) Inventor: Kenji Koido, Tokyo (JP)

(73) Assignee: Oki Data Corporation, Tokyo (JP)

( * ) Notice: Subject to any disclaimer, the term of this patent is extended or adjusted under 35 U.S.C. 154(b) by 287 days.

(21) Appl. No.: 12/318,318

(22) Filed: Dec. 24, 2008

(65) Prior Publication Data

US 2009/0190957 A1 Jul. 30, 2009

(30) Foreign Application Priority Data

Jan. 30, 2008 (JP) ..... 2008-018608

(51) Int. Cl.
*G03G 15/08* (2006.01)

(52) U.S. Cl. ..... 399/54; 399/223

(58) Field of Classification Search ..... 399/54, 399/228, 223; 430/45.55, 107.1
See application file for complete search history.

(56) References Cited

U.S. PATENT DOCUMENTS

| | | | | |
|---|---|---|---|---|
| 5,077,158 | A * | 12/1991 | Nakano | 430/123.56 |
| 6,013,403 | A * | 1/2000 | Ichikawa | 430/97 |
| 6,184,914 | B1 * | 2/2001 | Hoberock et al. | 347/240 |
| 2010/0136476 | A1 * | 6/2010 | Fujisaki et al. | 430/124.1 |

FOREIGN PATENT DOCUMENTS

| | | | |
|---|---|---|---|
| JP | 62090679 | A * | 4/1987 |
| JP | 01297675 | A * | 11/1989 |
| JP | 3-15860 | | 1/1991 |
| JP | 03164751 | A * | 7/1991 |
| JP | 03266851 | A * | 11/1991 |
| JP | 09-325619 | | 12/1997 |
| JP | 10-307445 | | 11/1998 |
| JP | 2002-139867 | | 5/2002 |
| JP | 2006-227308 | | 8/2006 |
| JP | 2007-65326 | | 3/2007 |

* cited by examiner

*Primary Examiner* — Robert Beatty
(74) *Attorney, Agent, or Firm* — Rabin & Berdo, PC

(57) ABSTRACT

An image forming apparatus includes a plurality of developing devices. Each developing devices performs an electrophotographic process to form an image. The image forming apparatus comprises a first developing device and a second developing device. The first developing device holds a black developer containing a first black coloring agent. The second developing device holds a gray developer. The gray developer contains a second black coloring agent and a coloring agent of a chromatic color. The chromatic color is a complementary color to the second black coloring agent.

20 Claims, 10 Drawing Sheets

IMAGE FORMING APPARATUS THAT INCLUDES A FIRST DEVELOPING DEVICE THAT HOLDS A BLACK DEVELOPER AND A SECOND DEVELOPING DEVICE THAT HOLDS A GRAY DEVELOPER

BACKGROUND OF THE INVENTION

1. Field of the Invention

The present invention relates to an image forming apparatus including a copying machine, a facsimile machine, or a printer.

2. Description of the Related Art

Some conventional image forming apparatuses are capable of printing halftone images with sharp image quality. One such image forming apparatus is disclosed in Japanese Patent Laid-Open No. 09-325619. A toner image is formed on a photoconductive body. The toner image is transferred by a transfer roller onto print paper. The photoconductive body and the transfer roller rotate in contact with each other such that a nip is formed between the photoconductive body and the transfer roller. A nip-adjusting mechanism adjusts the size of the nip in accordance with the transfer mode.

Such a conventional apparatus suffers from the problem in that image noise is apt to occur in the mid levels of halftone. In other words, the image noise appears in a direction substantially perpendicular to a direction in which the print paper is advanced.

SUMMARY OF THE INVENTION

The present invention was made in view of the aforementioned drawbacks.

An image forming apparatus includes a plurality of developing devices. Each of the developing devices performs an electrophotographic process to form an image. The image forming apparatus comprises a first developing device and a second developing device. The first developing device holds a black developer containing a first black coloring agent. The second developing device holds a gray developer. The gray developer contains a second black coloring agent and a coloring agent of a chromatic color. The chromatic color is a complementary color to the second black coloring agent.

A method is used for forming an image by operating a plurality of developing devices each of which performs an electrophotographic process to form an image. The method includes:

preparing a first developing device that holds a first developer containing a first black coloring agent;

preparing a second developer device that holds a second developer containing a second black coloring agent and a coloring agent of a chromatic color, the coloring agent of the chromatic color being complementary to a shade of the second black coloring agent;

printing a first portion of an image by operating the first developing device in accordance with a first range of print duty of the image; and printing a second portion of the image by operating the second developing device in accordance with a second range of print duty of the image.

Further scope of applicability of the present invention will become apparent from the detailed description given hereinafter. However, it should be understood that the detailed description and specific examples, while indicating preferred embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

First Embodiment

Figure 1:
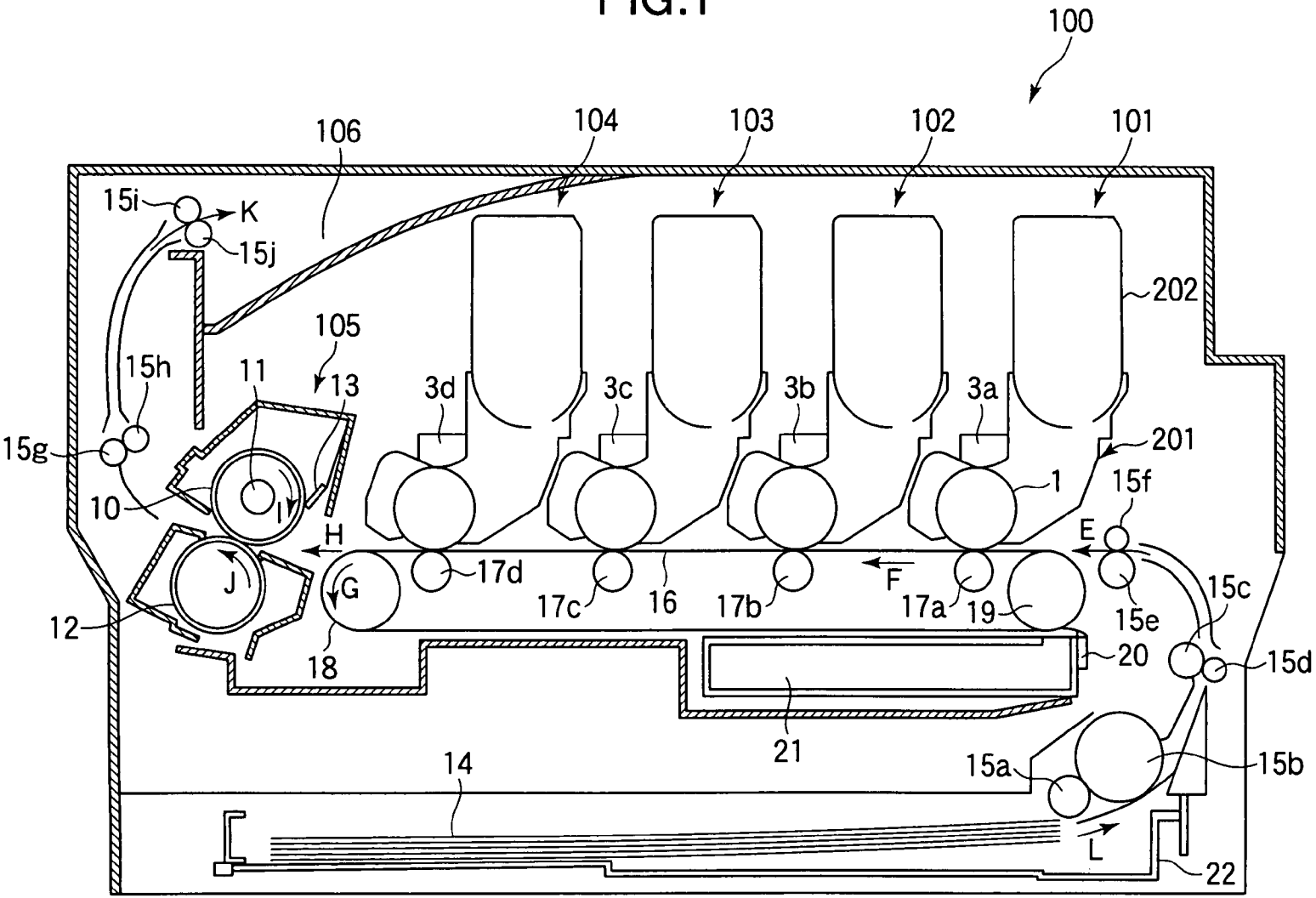
FIG. 1 illustrates a general configuration of an image forming apparatus of the invention.

FIG. 1 illustrates a general configuration of an image forming apparatus of the invention.

Referring to FIG. 1, four developing devices 101-104 are disposed along a transport path in which a print medium or print paper 14 is transported. The developing devices are of the same configuration, and differ in color only. Each developing section includes a body 201, an LED head, 3 and a toner cartridge 202. A fixing section 105 is disposed at the end of a row of the four developing devices 101-104. Transport rollers 15*a*-15*j* are disposed along the transport path of the paper 14, and transport the print paper 14 from the paper cassette 22 to a stacker 106 through the developing devices.

The developing devices 101-104 include transfer rollers 17*a*-17*d* parallel corresponding developing devices. The transfer belt 16 is sandwiched between the photoconductive drums and the transfer rollers, and is in pressure contact with the photoconductive drums and the transfer rollers. The transfer belt 16 is disposed about a drive roller 18 and an idle roller 19, and runs in a direction shown by arrow F, carrying the print paper 14 thereon. A cleaning blade 20 scrapes the transfer belt 16 to remove residual toner. A waste toner tank 21 holds the residual toner removed from the belt 16. LED heads 3*a*-3*d* parallel corresponding photoconductive drums, and illuminate the charged surfaces of the photoconductive drums. The LED heads 3*a*-3*d* are mounted to the body of the image forming apparatus 100.

Figure 2:
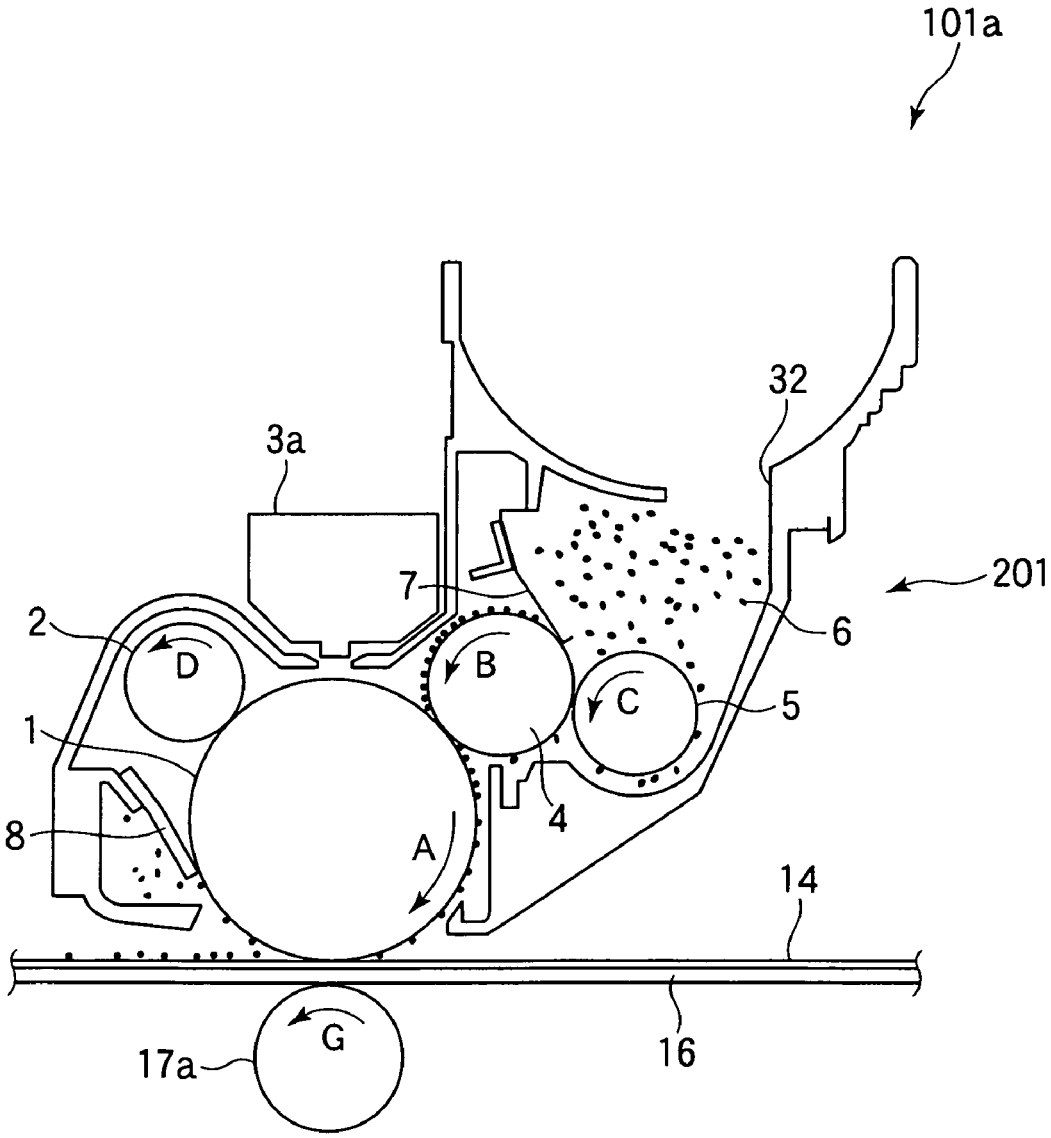
FIG. 2 is an expanded view of the body of a developing section, LED heads, and a transfer roller.

FIG. 2 is an expanded view of the body 201 of the developing section 101, LED heads 3*a*, and transfer roller 17*a*.

Referring to FIG. 2, the photoconductive drum 1 as an electrostatic latent image bearing body rotates in a direction shown by arrow A. A charging roller 2, the LED 3*a*, the developing roller 4, the transfer roller 17*a*, and a cleaning blade 8 are disposed around the photoconductive drum 1 in this order with respect to rotation of the photoconductive drum 1. The charging roller 2 rotates in a direction shown by arrow D in pressure contact with the circumferential surface of the photoconductive drum 1, and charges the circumferential surface. The LED head 3*a* employs LEDs as a light source, and illuminates the charged circumferential surface of the photoconductive drum 1 to form an electrostatic latent image. The LED head 3*a* is mounted on the body of the image forming apparatus. The developing roller 4 supplies toner (here black toner) to the electrostatic latent image to form a toner image. The cleaning blade 8 scrapes the residual toner off the photoconductive drum 1 after transfer of the toner image onto the print paper 14.

A supply roller 5 receives the toner 6 from the toner cartridge 202 (FIG. 1) and supplies the toner 6 to the developing roller 4. A developing blade 7 is in contact with the circumferential surface of the developing roller 4 to form a thin layer of toner 6 on the developing roller 4.

The photoconductive drum 1 includes an aluminum hollow shaft covered with a layer of a photoconductive material (e.g., organic photoconductive material). The layer includes a charge generation layer and a charge transport layer laminated one over the other. The charging roller 12 includes a metal shaft covered with a layer of semi-conductive epichlorohydrin rubber. The developing roller 4 includes a metal shaft covered with a layer of semi conductive urethane rubber. The supply roller 5 includes a metal shaft covered with a layer of semi-conductive foamed silicone sponge. The developing blade 7 is formed of stainless steel. The cleaning blade 8 is formed of urethane rubber.

The photoconductive drum 1 may be an organic photoconductive drum, which includes an electrically conductive roller (e.g., aluminum) covered with a photoconductive layer of an organic material formed of a binder resin in which a charge generation agent and charge transport layer are dispersed. Alternatively, the photoconductive drum 1 may be an inorganic photoconductive drum, which includes an electrically conductive roller (e.g., aluminum) covered with a layer of a photoconductive material, for example, selenium photoconductor or amorphous silicone. The developing roller 4 may be a conventional roller that includes an electrically conductive roller (e.g., stainless steel) covered with silicone rubber or urethane carbon mixed with, for example, carbon to adjust the electrical resistance of the roller. The developing blade 7 may be formed of a material, for example, stainless steel, or a conventional material including silicone rubber. A voltage may be applied to the developing blade 7 when the developing roller 7 and the developing blade 7 are in operation.

The cleaning blade 8 and cleaning blade 20 (FIG. 1) are formed of a resilient material including urethane rubber, epoxy rubber, acrylic rubber, fluorine rubber, nitrile rubber (NBR), stylene-butadiene rubber (SBR), isoprene rubber, and Polybutadiene rubber.

Figure 3:
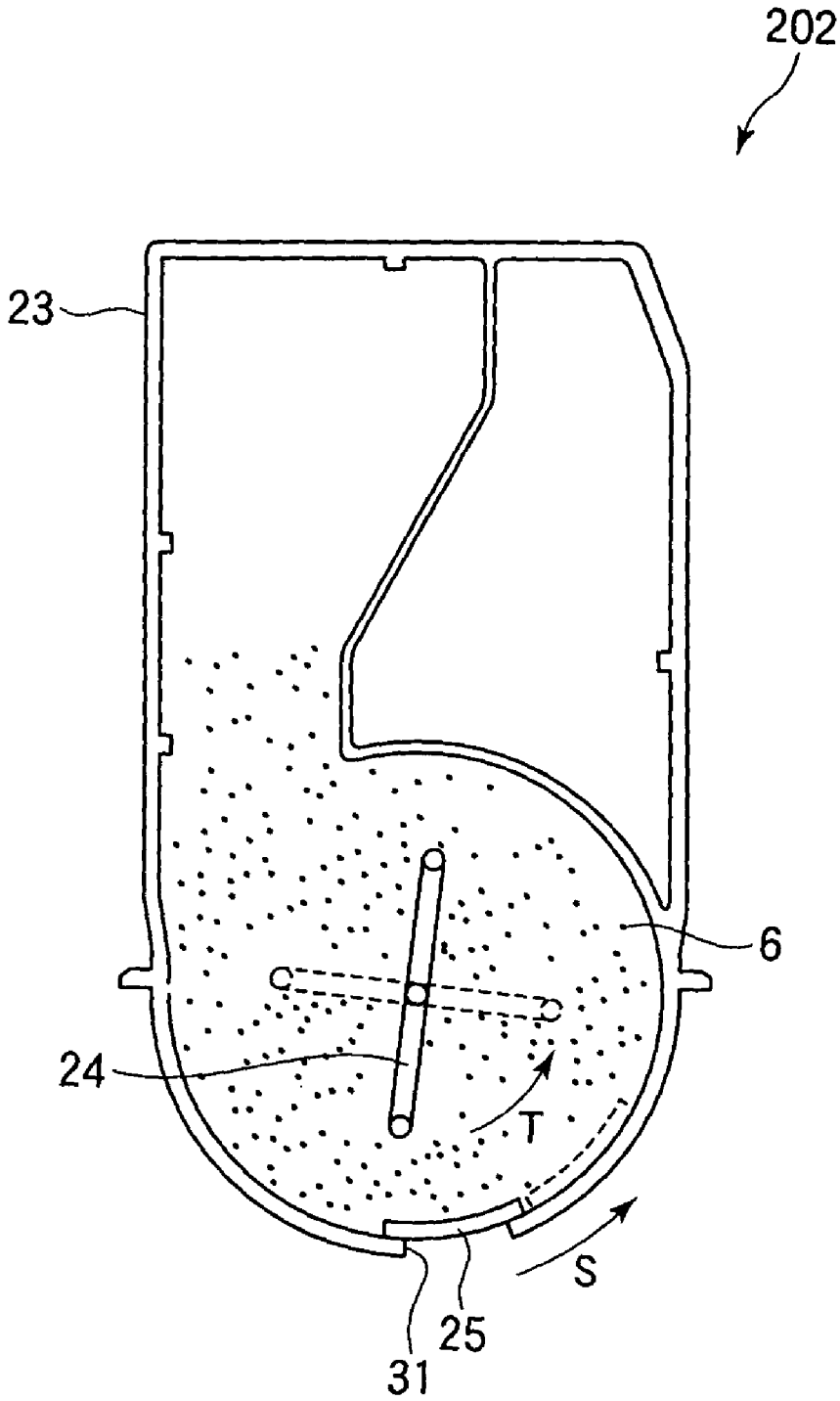
FIG. 3 illustrates a pertinent portion of an inside of a toner cartridge.

FIG. 3 illustrates a pertinent portion of an inside of the toner cartridge 202, which is a developer holding section that holds toner as a developer. The toner cartridge 202 includes a toner cartridge case 23, an agitator bar 24, and a shutter 25. The shutter 25 closes a toner discharging opening 31 through which the toner 6 is discharged, thereby preventing the toner 6 from leaking.

Figure 4:
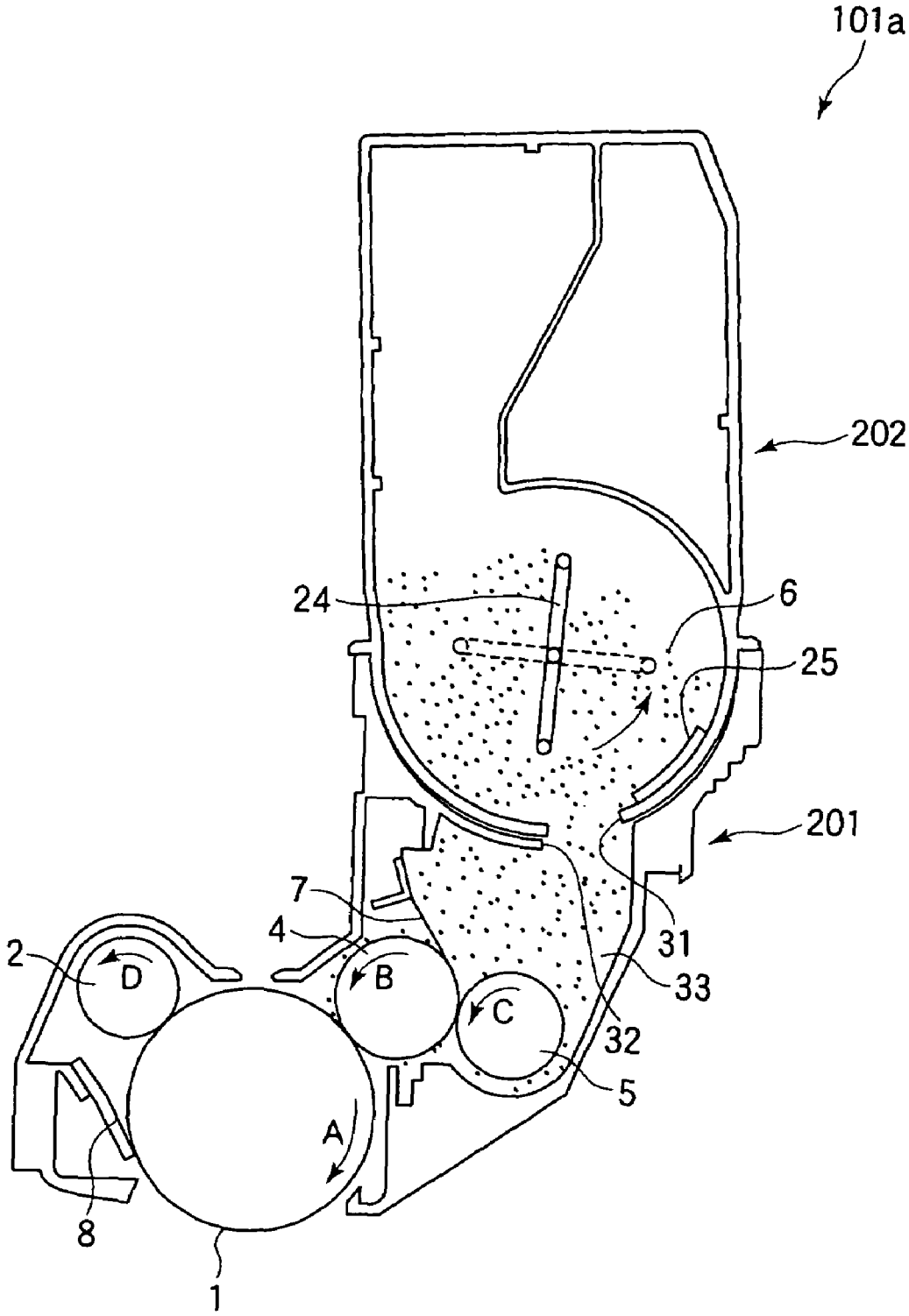
FIG. 4 illustrates the toner cartridge when it is attached to the body of the developing section.

FIG. 4 illustrates the toner cartridge 202 when it is attached to the body 201 of the developing section 101. The toner discharging opening 31 of the toner cartridge 202 faces a toner receiving opening 32 of the body 201 of the developing section 101. When the shutter 25 moves relative to the toner discharging opening 31, the toner is discharged form the toner cartridge 202 through the toner discharging opening 31 into a toner reservoir 33 of the body 201 of the developing section. The shutter 25 remains open till the toner cartridge 202 is replaced upon exhaustion of the toner. The shutter 25 is closed before the toner cartridge 202 is detached from the body 201.

The developing devices 101-104 differ in the type of toner. The developing section 101 as a first developing device holds black toner. The developing device 102 as a second developing device and the developing devices 103-104 hold gray toners of different densities, respectively. The positions of the developing devices 101-104 along the transport path that hold black toner or gray toner are not limited to that shown in FIG. 1. The number of developing devices that hold gray toner may be one or more.

The term "print duty" used herein refers to the ratio of an area in which the developer is actually deposited to a total printable area in which am image may be printed. Print duty is expressed in percent (%).

The image data describes the print duty of dots that should be formed on the photoconductive drum. The amount of light that illuminates the photoconductive drum 1 may vary from dot to dot even though the image data describes the same print duty. The developing devices 101-104 are operated such that the developing section 101 prints, for example, a first portion of an image in accordance with a first range of print duty of the image, then the developing section 102 prints a second portion of the image in accordance with a second range of print duty of the image, then the developing section 103 prints a third portion of the image in accordance with a third range of print duty of the image, and finally the developing section 104 prints a fourth portion of the image in accordance with a fourth range of print duty of the image. In this manner, each of the developing devices prints a corresponding portion of the image having print duties in a corresponding range of print duty in accordance with the image data.

The fixing section 105 includes a heat roller 10 and a pressure roller 12 that are in pressure contact with each other. The heat roller 10 includes a hollow shaft (e.g., aluminum) covered with a heat-resistant resilient layer of silicone rubber. The heat resistant layer is covered with a tube of tetrafluoride ethylene-per-fluoroalkylvinylether resin (PFA). The pressure roller 12 includes an aluminum shaft covered with a heat resistant resilient layer of silicone rubber. The heat resistant resilient layer is covered with a PFA tube. A halogen lamp 11 is discharged inside the heat roller 10. A thermistor 13 is disposed such that the thermistor 13 is not in contact with the heat roller 10.

Toner of the first embodiment will be described.

The toner contains a binder, a release agent, a coloring agent, and additional additives. Examples of binder resins include polyester resins, styrene acrylic resins, epoxy resins, and stylene-butadiene resins.

Examples of release agents include copolymers of low molecular weight polyethylene, low molecular weight polypropylene, and olefin; alphatic hydrocarbon waxes including micro crystalline wax, paraffin wax, and Fischer-Tropsch wax; oxides of aliphatic hydrocarbon waxes including oxidized polyethylene wax or block copolymers of aliphatic hydrocarbon waxes; waxes including carnauba wax and montanic acid ester wax whose major composition is a fatty acid ester; waxes obtained by partially or entirely oxidizing fatty acid esters including deoxidized carnauba wax. The release agent should be present preferably in an amount of 0.1-15 mass parts, more preferably 0.5-12 mass parts, based on 100 mass parts of the binder resin. A plurality of waxes may also be used in combination.

A coloring agent may be black toner and colored toners including conventional dyes and pigments. Examples of coloring agents include carbon black, iron oxide, phthalocyanine blue, permanent brown FG, brilliant first scarlet, pigment green B, rhodamine-B-base, Solvent Red 49, Solvent Red 146, pigment blue 15:3, Solvent Blue 35, quinacridone, carmine 6B, and disazo yellow.

The additives including a charge control agent, a conductivity control agent, a loading pigment, a fibrous reinforce agent, antioxidant, an anti-aging agent, and a fluidity adding agent may be added as required.

The toner of the embodiment contains an inorganic fine powder for improving environment stability, charging stability, developability, flowability, and storage stability. It is preferable that the inorganic fine powder is externally added to the toner. The inorganic fine powder is preferably a hydrophobic fine powder, and may include silica fine powders, which vary in particle diameter or hydrophobizing process, and hydrophobized inorganic fine powders including titania and alumina.

The toner may be manufactured by a conventional process including pulverization and polymerization. The toner may be a one-component type or a two-component type.

The manufacturing process of the toner will be described.

TONER #1

The following materials were placed in a Henschel mixer and were mixed: 100 mass parts of binding resin (polyester resin, number average molecular weight Mn=3700, glass transition temperature Tg=62° C., softening temperature $T_{1/2}$=115° C.); 0.5 mass parts of TT-77 (available from HODOGAYA KAGAKU KOGYOSHA) as a charge control agent; 5.0 mass parts of carbon black (black coloring agent, "MOGUL-L" available from CABOT); and 4.0 mass parts of carnauba wax (carnauba wax, powder No. 1, available from KATO YOKO SHA) as a release agent. Then, the pulverized mixture was melted and kneaded with a twin screw extruder. The kneaded material was cooled, and coarse pulverization of the cooled material was performed using a cutter mill having a screen of a 2-mm diameter. The pulverized material was further pulverized using a dispersion separator (Japan Pneumatic Industry Company Ltd.) as a pulverizer, and was then classified using a pneumatic separator to obtain a base toner.

An amount of 3.0 mass parts of hydrophobic silica R972 (average primary particle diameter of 16 nm, available from NIPPON AEROSIL CO., Ltd.) was added as an external additive to the base toner, and the mixture was then agitated for 3 minutes in a Henschel mixer, thereby obtaining TONER #1. The average volume mean particle diameter of TONER #1 was measured with a cell counter (Coulter Multicizer III) at an aperture of 100 μm and 30000 counts. The average volume mean particle diameter was 6.0 μm.

TONERs #2-#11

TONER #2 was manufactured in the same way as TONER #1 except that 4.0 mass parts of carbon black was added. The average volume mean particle diameter of TONER #2 was 6.0 μm.

TONER #3 was manufactured in the same way as TONER #1 except that 3.0 mass parts of carbon black was added.

TONER #4 was manufactured in the same way as TONER #1 except that 2.0 mass parts of carbon black was added.

TONER #5 was manufactured in the same way as TONER #1 except that 1.0 weight part of carbon black was added.

TONER #6 was manufactured in the same way as TONER #1 except that 1.0 mass parts of carbon black as a black agent and 0.05 mass parts of pigment blue 15:3 (ECB-301 available from DAINICHISEIKA) as a chromatic coloring agent were added. Reducing the amount of carbon black causes the overall shade of color of printed images to become reddish. Thus, pigment blue 15:3, which is a color complementary to red, is added to correct a reddish color to black. In other words, complementary red is used.

TONER #7 was manufactured in the same way as TONER #1 except that 1.0 mass parts of carbon black as a black agent and 0.1 mass parts of pigment blue 15:3 (ECB-301 available from DAINICHISEIKA) were added as a chromatic color agent.

TONER #8 was manufactured in the same way as TONER #1 except that 15.0 mass parts of a metal oxide (MC-7 available from MITSUI KINZOKU KOGYO) was added as a black agent in place of carbon black.

TONER #9 was manufactured in the same way as TONER #1 except that 3.0 mass parts of a metal oxide (MC-7 available from MITSUI KINZOKU KOGYO) was added as a black agent in place of carbon black.

TONER #10 was manufactured in the same way as TONER #1 except that 3.0 mass parts of a metal oxide (MC-7 available from MITSUI KINZOKU KOGYO) as a black agent and 0.05 mass parts of pigment blue 15:3 (ECB-301 available from DAINICHISEIKA) as a chromatic color agent were added.

TONER #11 was manufactured in the same way as TONER #1 except that 3.0 mass parts of a metal oxide (MC-7 available from MITSUI KINZOKU KOGYO) as a black agent in place of carbon black and 0.1 mass parts of pigment blue 15:3 (ECB-301 available from DAINICHISEIKA) as a chromatic color agent were added.

TONER #12 was manufactured in the same way as TONER #1 except that 0.5 mass parts of carbon black as a black agent and 0.1 mass parts of pigment blue 15:3 (ECB-301 available from DAINICHISEIKA) as a chromatic color agent were added.

TONER #13 was manufactured in the same way as TONER #1 except that 0.25 mass parts of carbon black as a black agent and 0.1 mass parts of pigment blue 15:3 (ECB-301 available from DAINICHISEIKA) as a chromatic color agent were added.

Table 1 shows the proportions of compositions for TONERs #1-#13. The average mean particle diameters of TONERs #1-#13 were 6.0 μm.

TABLE 1

| | Coloring agent 1 | | Coloring agent 2 | | (Chromatic color agent)/ |
|---|---|---|---|---|---|
| TONERs | Type | Amount | Type | Amount | (Black agent) |
| TONER #1 | Carbon black | 5.4 | | | |
| TONER #2 | Carbon black | 4.0 | | | |
| TONER #3 | Carbon black | 3.0 | | | |
| TONER #4 | Carbon black | 2.0 | | | |
| TONER #5 | Carbon black | 1.0 | | | |
| TONER #6 | Carbon black | 1.0 | P.B | 0.05 | 0.050 |
| TONER #7 | Carbon black | 1.0 | 15:3 | 0.1 | 0.100 |
| TONER #8 | Metal oxide | 15.0 | | | |
| TONER #9 | Metal oxide | 3.0 | | | |
| TONER #10 | Metal oxide | 3.0 | P.B | 0.05 | 0.017 |
| TONER #11 | Metal oxide | 3.0 | 15:3 | 0.1 | 0.033 |
| TONER #12 | Carbon black | 0.5 | | 0.1 | 0.200 |
| TONER #13 | Carbon black | 0.25 | | 0.1 | 0.400 |

The operation of the image forming apparatus 100 will be described with reference to FIGS. 1-4.

Image formation includes charging, exposing, developing transferring, and fixing processes. During the charging process, the photoconductive drum 1 is driven in rotation by a drive source (not shown) in the A direction (FIG. 2) at a constant circumferential speed. The charging roller 2 also rotates in contract with the circumferential surface of the photoconductive drum 1 in the D direction. A high voltage source supplies a high d-c voltage to the charging roller 2, which in turn charges the entire circumferential surface of the photoconductive drum 1 uniformly. During the exposing process, the LED head 3 illuminates the charged surface of the photoconductive drum 1 in accordance with an image signal. The potential of illuminated areas on the charged surface decrease, so that the illuminated areas form an electrostatic latent image as a whole.

During the developing process, an agitator bar 24 rotates in a direction shown by arrow T (FIG. 3). Thus, the toner 6 is discharged from the toner cartridge 202, and falls into the body 201 of the developing section. The supply roller 5 receives a high voltage from a high voltage power supply (not shown), and rotates in a direction shown by arrow C, thereby supplying the toner 6 to the developing roller 4.

The developing roller 4 rotates in intimate contact with the photoconductive drum 1 in a direction shown by arrow B. The developing roller 4 receives a high voltage from a high voltage power supply (not shown), and attracts the toner 6 supplied from the supply roller 5. The developing blade 7 is in pressure contact with the circumferential surface of the developing roller 4 to form a thin layer of toner having a uniform thickness on the developing roller 4.

The developing roller 4 supplies the toner 6 to the photoconductive drum 1 to develop the electrostatic latent image with the toner 6, thereby forming a toner image on the photoconductive drum 1. A high voltage power supply applies a high voltage across the shaft of the photoconductive drum 1 and the shaft of the developing roller 4, thereby creating an electric field between the developing roller 4 and the photoconductive drum 1. The charged toner 6 migrates from the developing roller 4 to the photoconductive drum 1 due to the electric field, being attracted to the electrostatic latent image to form the toner image.

Referring to FIG. 1, the print paper 14 is advanced by the transport rollers 15*a* and 15*b* from the paper cassette 22 in a direction shown by arrow L, and is further transported by transport rollers 15*c*-15*f* in a direction shown by arrow E. The drive roller 18 rotates in a direction shown by arrow G so that the print paper 14 is further transported in the F direction to the transfer belt 16.

During the transferring, the transfer roller 17*a* receives a high voltage from a high voltage power supply (not shown), and transfers the toner image onto the print paper 14. The transfer belt 16 transports the print paper 14 in the F direction, the print paper 14 carrying the toner image thereon. The transfer belt 16 transports the print paper 14, passing through the following developing devices 102, 103 and 104, the transfer rollers 17*b*, 17*c*, and 17*d* transferring toner images of corresponding colors one over the other in registration onto the print paper 14 as the print paper 14 advances in the H direction.

During fixing process, the print paper 14 passes through a fixing point defined between the heat roller 10 and pressure roller 12 in the fixing section 105, so that the toner images are fused into the print paper 14. The thermistor 13 disposed in the vicinity of the heat roller 10 detects the surface temperature of the heat roller 10. A temperature controller (not shown) energizes or de-energizes the halogen lamp 11 in accordance with the output of the thermistor 13, thereby maintaining the surface temperature constant. The heat roller 10 and pressure roller 12 rotate in directions shown by arrows I and J, respectively, so that the print paper 14 passes through the transfer point where the toner images are fused by heat and pressure.

Then, the print paper 14 is further advanced by the transport rollers 15*g*-15*j* in a direction shown by arrow K, and is discharged onto the stacker 106 of the image forming apparatus 100.

Referring to FIG. 2, some of the toner 6 may remain on the photoconductive drum 1 after transfer of the toner image onto the print paper. This residual toner is removed by the cleaning blade 8 during the cleaning process. The cleaning blade 8 is mounted on a rigid supporting board, and parallels the photoconductive drum 1 in contact with the circumferential surface of the photoconductive drum 1. When the photoconductive drum 1 rotates, the cleaning blade 8 scrapes the residual toner off the photoconductive drum 1, so that the surface of the photoconductive drum 1 is ready for the next image formation cycle.

Experiments were conducted to evaluate the previously described toners using the aforementioned image forming apparatus 100. The experiments and results will be described in terms of EXAMPLES #1 to #4 and comparisons #1 and #2.

EXAMPLE #1

Printing was performed under the following conditions using the image forming apparatus 100.

(1) The image forming apparatus, print paper, and toner were left in an environment of 23° C. and 40% RH.

(2) A4 size paper (OKI, excellent white paper having a basic weight of 180 g/m$^2$) was used as print paper. Printing was performed on a surface of the print paper opposite to that appearing when the package of a stack of print paper was unsealed. The print paper was transported in a portrait orientation in the image forming apparatus 100.

(3) The surface temperature of the heat roller 10 of the fixing section 105 was set to 175° C.

Figure 13:
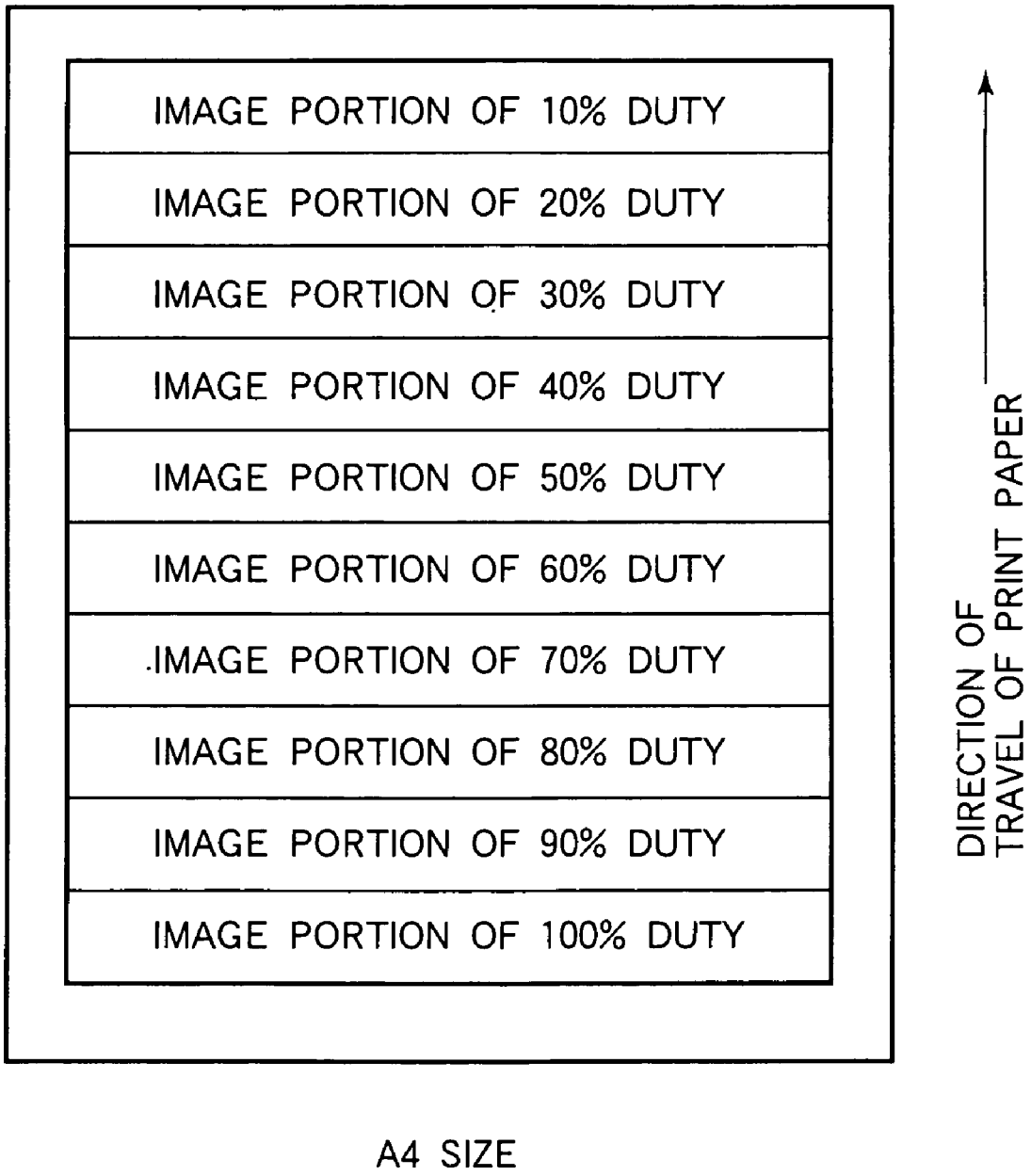
FIG. 13 illustrates image portions having different halftone levels expressed with different symbols.

(4) A halftone test patch had print duties in the range of 10-100% in increments of 10%. The print paper was advanced at a speed of 250 mm/s during printing. FIG. 13 illustrates image portions having different halftone levels expressed with different symbols.

Figure 5:
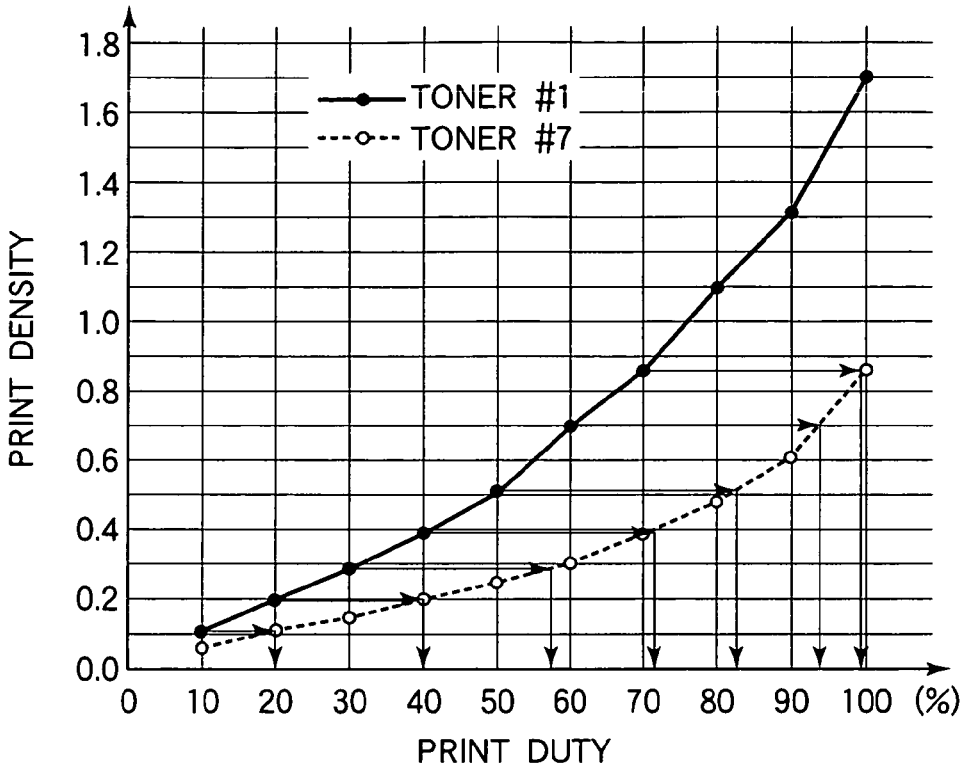
FIG. 5 illustrates a graph of the results shown in Table 2.

Printing was performed using the developing section 101 that holds TONER #1. The hue of an area of a print duty of 100% (solid printing) and the print density of image portions having the respective halftone levels in the printed image were measured using a spectrodensitometer (XRite 528 available from FLEXO, status I, D50 light source, a field of view of 2 degrees). Tables 2 and 3 list the experimental results. FIG. 5 illustrates a graph of the results shown in Table 2. Table 4 illustrates the non-uniformity in the density of printed images evaluated by inspection. The term "density" refers to a human perceived visual image darkness, and is a quantity usually measured by an optical densitometer.

TABLE 2

| BLACK SECTION | GRAY SECTION | PRINT DUTY (%)/PRINT DENSITY | | | | | | | | | |
|---|---|---|---|---|---|---|---|---|---|---|---|
| | | 10% | 20% | 30% | 40% | 50% | 60% | 70% | 80% | 90% | 100% |
| TONER #1 | | 0.11 | 0.19 | 0.28 | 0.38 | 0.51 | 0.69 | 0.85 | 1.09 | 1.31 | 1.70 |
| | Toner #7 | 0.06 | 0.11 | 0.15 | 0.19 | 0.24 | 0.3 | 0.37 | 0.47 | 0.61 | 0.86 |

TABLE 3

| TONER | a* | B* | ΔEab |
|---|---|---|---|
| TONER #1 | 2.5 | 3.4 | 4.2 |
| TONER #7 | 2.2 | 2.8 | 3.6 |

(print duty = 100%)

TABLE 4

| BLACK SECTION | GRAY SECTION | PRINT DUTY (%)/DENSITY UNEVENNESS | | | | | | | | | |
|---|---|---|---|---|---|---|---|---|---|---|---|
| | | 10% | 20% | 30 | 40% | 50% | 60% | 70% | 80% | 90% | 100% |
| TONER #1 | | A | A | A | B | B | C | C | A | A | A |
| | Toner #7 | A | A | A | A | A | B | B | A | A | A |

A streak(s) may appear in a printed image which has a higher density than a normal density image. The streak may have a width of several millimeters or several tens of millimeters. A streak(s) is a portion of a printed image that extends in a direction in which the print paper advances and that has a density different from areas surrounding the streak. In other words, a streak is an example of density unevenness. As is clear from Table 4, symbol "A" denotes that no density unevenness (streaks) occurred for the image portions having print duties in the ranges of 80-100% and 10-30%. Symbol "C" denotes that density unevenness (streaks) was observed in a direction in which the print paper advances, for image portions having print duties in the range of 60-70%. Symbol "B" denotes that slight, partial density unevenness (streaks) occurred for image portions having print duties in the range of 40-50%. For image portions (symbol "A") having print duties in the range of 10-30%, no streak appeared in a direction in which the print paper advances. Symbols "A", "B", and "C" apply to all tables hereinafter.

The amount of light that illuminates the photoconductive drum 1 may vary from dot to dot. This variation in the amount of light causes uneven density in dots developed with the toner. Thus, the density of dots is not uniform even though the data for the dots describes the same density. This is referred to as "density unevenness". For this reason, the higher the print duty is, the less the density unevenness is noticeable. The lower the print duty is, the smaller the dot size is, and the variation in dot diameter increases, making the density unevenness of print images more detectable.

The respective quantities a* and b* in the L*a*b* color space were obtained by using the spectrodensitometer (XRite 528). The values of saturation „Eab were then calculated using the following equation (1).

$$„Eab=\{(a^*)^2+(b^*)^2\}^{1/2} \quad \text{Eq. (1)}$$

where „Eab is saturation, a* is a redness-greenness value, and b* is a yellowness-blueness value.

Table 3 shows the results. The smaller the value of „Eab is, the more achromatic the color is.

Lightness L* varies depending on the fixing temperature, and the characteristics of a print pattern is not evaluated accordingly.

The developing section 101 was then detached from the image forming apparatus 100, and the gray developing section 102 that holds TONER #7 was attached to the image forming apparatus 100. Halftone printing was performed, and then the density, hue, and density unevenness of the printed image were measured. Then, the density unevenness was evaluated. These results are shown in Tables 2, 3, and 4.

The print density of an area of a print duty of 100% printed using TONER #7 was substantially the same as that of an area of a print duty of 70% printed using TONER #1. When TONER #1 was used, the saturation of the hue was „Eab=3.6 as shown in Table 3. As shown in Table 4, no density unevenness occurred in image portions having print duties in the range of 80-100% (denoted by A). Little but acceptable density unevenness occurred in image portions having print duties in the range of 60-70%. Streaks having high density and streaks having low density were not observed in image portions having print duties in the range of 10-50% (denoted by A). This may be due to the low print duty in the direction in which the print paper advances.

Halftone printing was performed using the developing section 101 that holds TONER #1 and the developing section 102 that holds TONER #7. TONER #1 was used to print the image portions of having print duties in the range of 80-100%, and TONER #7 was used to print the image portions having print duties in the range of 10-70%. Table 5 shows the density unevenness of the printed images.

TABLE 5

| BLACK SECTION | GRAY SECTION | PRINT DUTY (%)/PRINT ENEVENESS | | | | | | | | | |
|---|---|---|---|---|---|---|---|---|---|---|---|
| | | 10% | 20% | 30% | 40% | 50% | 60% | 70% | 80% | 90% | 100% |
| TONER #1 | | NO | NO | NO | NO | NO | NO | NO | 80% | 90% | 100% |
| | Toner #7 | 20% | 40% | 56% | 72% | 83% | 93% | 100% | NO | NO | NO |
| TONER #1 | TONER #7 | A | A | A | A | A | A | A | A | A | A |

(Symbol "NO" denotes that the toner is not used.)

As is clear from FIG. 5, there is a correlation between the print density of an image printed using TONER #7 and that printed using TONER #1. For example, in order to achieve a print density of about 0.2 (FIG. 5) by using TONER #1, an image should be printed using TONER #1 at a print duty of about 20%. In other words, if TONER #7 is used to print an image, the image should be printed at a print duty of about 40%, in order to achieve an apparent print duty equivalent to a print duty of about 20% obtained by using TONER #1. If an image printed using TONER #7 is to achieve a print duty in the range of 10-70% obtained using TONER #1, the image should be printed with the print duties shown in Table 5.

As shown in Table 5, no uneven density was observed by inspection over the entire range of halftone levels. In other words, images having good print quality may be obtained using TONER #7 for image portions having print duties not higher than 70%, and TONER #1 for image portions having print duties higher than 70%.

COMPARISON #1

Figure 6:
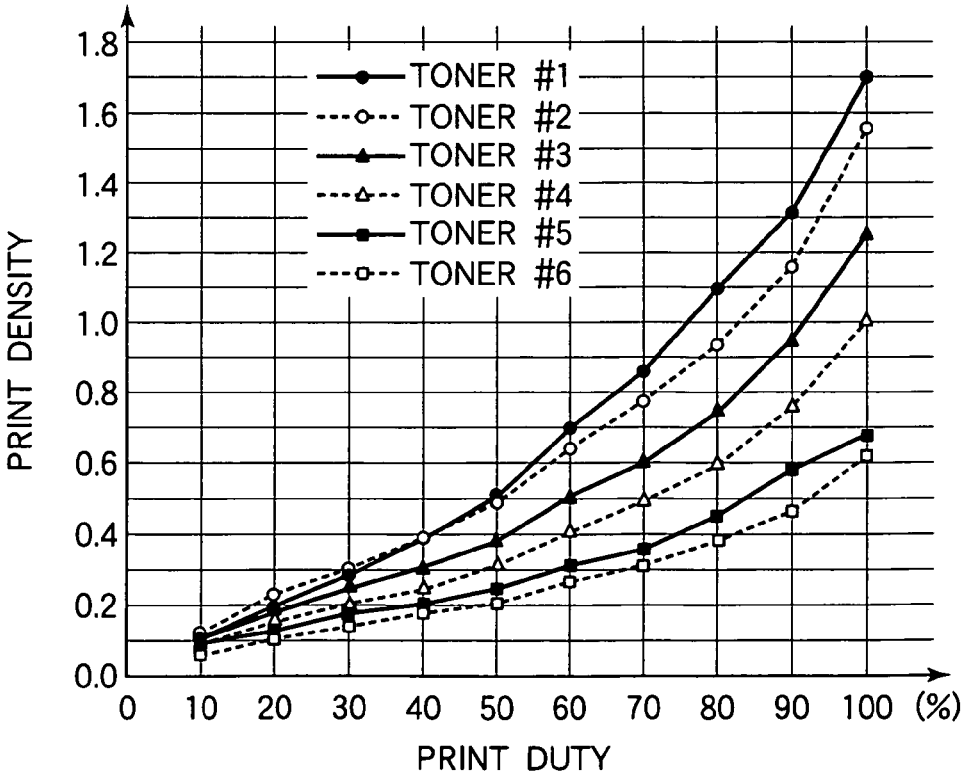
FIG. 6 plots the results shown in Table 6.
Figure 7:
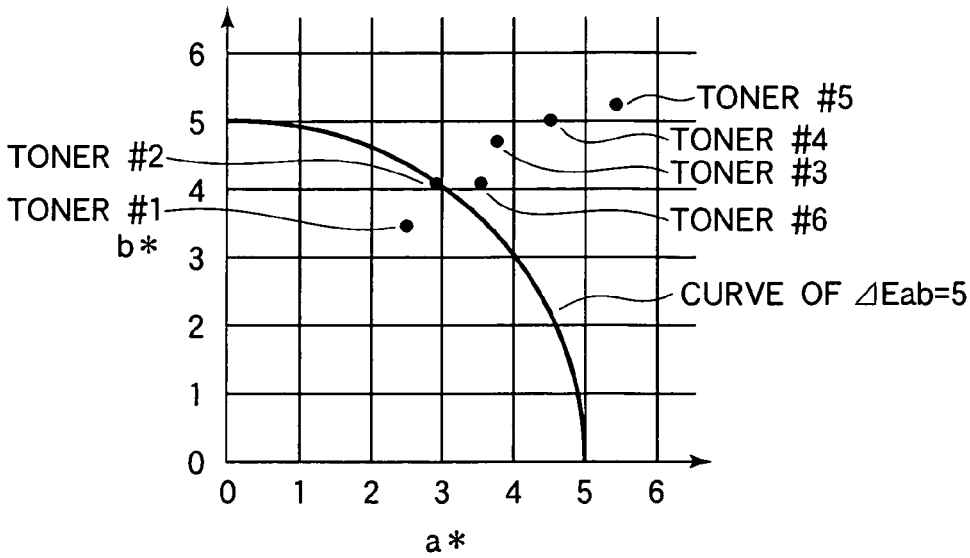
FIG. 7 plots the results shown in Table 7.

Experiments were conducted using TONERs #2 to #6 in the same way as EXAMPLE #1 to measure the density and hue of printed images, thereby determining the density unevenness of the printed images. The results are shown in Tables 6, 7, and 8. FIG. 6 plots the results shown in Table 6, and FIG. 7 plots the results shown in Table 7.

TABLE 6

| BLACK SECTION | GRAY SECTION | PRINT DUTY (%)/PRINT DENSITY | | | | | | | | | |
|---|---|---|---|---|---|---|---|---|---|---|---|
| | | 10% | 20% | 30% | 40% | 50% | 60% | 70% | 80% | 90% | 100% |
| TONER #1 | | 0.11 | 0.19 | 0.28 | 0.38 | 0.51 | 0.69 | 0.83 | 1.09 | 1.31 | 1.70 |
| | TONER #2 | 0.12 | 0.23 | 0.30 | 0.38 | 0.47 | 0.63 | 0.75 | 0.92 | 0.16 | 0.55 |
| | TONER #3 | 0.10 | 0.19 | 0.24 | 0.31 | 0.38 | 0.51 | 0.60 | 0.74 | 0.94 | 0.25 |
| | TONER #4 | 0.08 | 0.15 | 0.19 | 0.25 | 0.30 | 0.41 | 0.48 | 0.59 | 0.75 | 1.00 |
| | TONER #5 | 0.08 | 0.12 | 0.17 | 0.20 | 0.25 | 0.31 | 0.36 | 0.44 | 0.57 | 0.67 |
| | TONER #6 | 0.08 | 0.10 | 0.14 | 0.17 | 0.21 | 0.26 | 0.31 | 0.37 | 0.46 | 0.62 |

TABLE 7

| TONERs | a* | B* | ΔEab |
|---|---|---|---|
| TONER #1 | 2.5 | 3.4 | 4.2 |
| TONER #2 | 2.9 | 4.1 | 5.0 |
| TONER #3 | 3.8 | 4.7 | 6.0 |
| TONER #4 | 4.6 | 5.0 | 6.8 |
| TONER #5 | 5.4 | 5.2 | 7.5 |
| TOENR #6 | 3.6 | 4.1 | 5.5 |

(print duty = 100%)

TABLE 8

| GRAY SECTION | PRINT DUTY (%)/DENSITY UNEVENNESS | | | | | | | | | |
|---|---|---|---|---|---|---|---|---|---|---|
| | 10% | 20% | 30% | 40% | 50% | 60% | 70% | 80% | 90% | 100% |
| TONER #1 | A | A | A | B | B | C | C | A | A | A |
| TONER #2 | A | A | A | B | B | C | C | A | A | A |
| TONER #3 | A | A | A | B | B | B | C | A | A | A |
| TONER #4 | A | A | A | A | B | B | C | A | A | A |
| TONER #5 | A | A | A | A | A | B | B | A | A | A |
| TONER #6 | A | A | A | A | A | B | B | A | A | A |

As is clear from the saturation of hue shown in Table 7 and FIG. 7, TONERs #2 to #6 exhibit saturation ΔEab higher than 5, so that the shades of color of the printed images are brownish. For solving this problem, just as described with reference to Table 5 in EXAMPLE #1, images were printed by combining TONER #2 to #6 with TONER #1. The continuity of the shades of color is lost at the boundaries of combined toners, so that the printed image was unacceptable as a monochrome image. Because toners that exhibit the values of saturation ΔEab higher than 5 cause printed images to become brownish, the practical toner should have a value of saturation ΔEab not higher than 5.

EXAMPLE #2

Figure 8:
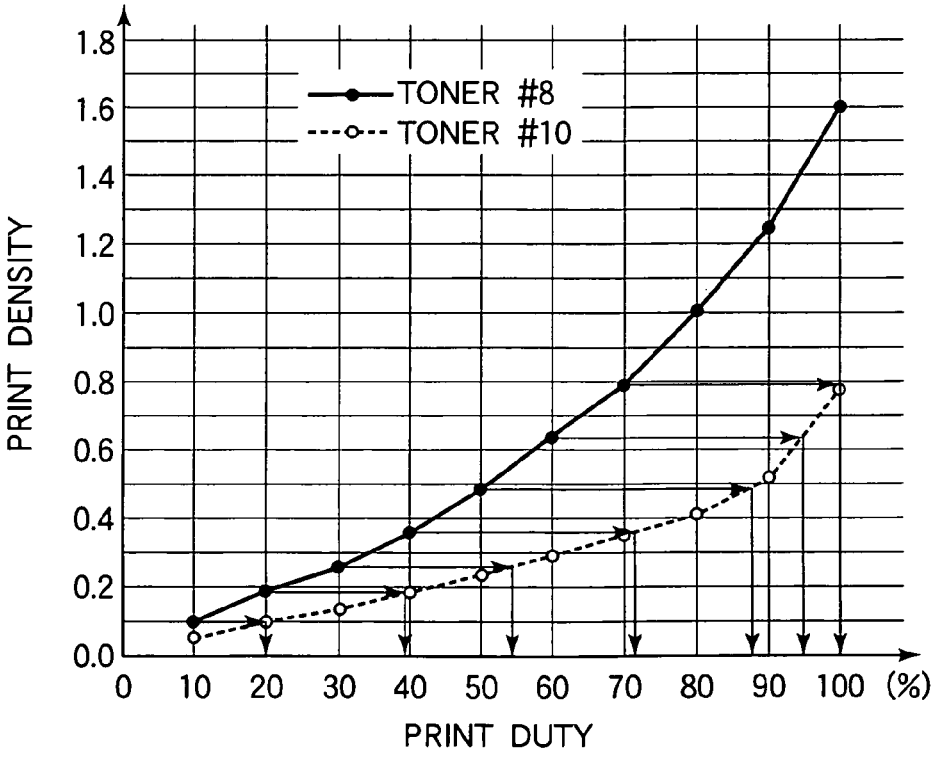
FIG. 8 plots the results shown in Table 9.

Experiments were conducted in the same way as EXAMPLE #1 except that TONERs #8 and #10 were used to measure the density and hue of printed images, thereby determining the density unevenness of the printed images. The results are shown in Tables 9, 10, 11, and 12. FIG. 8 plots the results shown in Table 9.

TABLE 9

| BLACK SECTION | GRAY SECTION | PRINT DUTY (%)/PRINT DENSITY | | | | | | | | | |
|---|---|---|---|---|---|---|---|---|---|---|---|
| | | 10% | 20% | 30% | 40% | 50% | 60% | 70% | 80% | 90% | 100% |
| TONER #8 | | 0.11 | 0.189 | 0.26 | 0.36 | 0.48 | 0.63 | 0.77 | 0.99 | 1.23 | 1.60 |
| | TONER #10 | 0.06 | 0.10 | 0.14 | 0.18 | 0.23 | 0.28 | 0.35 | 0.41 | 0.52 | 0.77 |

TABLE 10

| TONER | a* | B* | ΔEab |
|---|---|---|---|
| TONER #8 | 3.5 | 2.0 | 4.0 |
| TONER #10 | 3.0 | 0.6 | 3.1 |

(Print duty = 100%)

TABLE 11

| BLACK SECTION | GRAY SECTION | PRINT DUTY (%)/DENSITY UNEVENNESS 10% | 20% | 30% | 40% | 50% | 60% | 70% | 80% | 90% | 100% |
|---|---|---|---|---|---|---|---|---|---|---|---|
| TONER #8 | | A | A | A | B | B | C | C | A | A | A |
| | TONER #10 | A | A | A | A | A | B | B | A | A | A |

TABLE 12

| BLACK SECTION | GRAY SECTION | PRINT DUTY (%)/DENSITY UNEVENNESS 10% | 20% | 30% | 40% | 50% | 60% | 70% | 80% | 90% | 100% |
|---|---|---|---|---|---|---|---|---|---|---|---|
| TONER #8 | | NO | NO | NO | NO | NO | NO | NO | 80% | 90% | 100% |
| | TONER #10 | 20% | 38% | 54% | 70% | 86% | 93% | 100% | NO | NO | NO |
| TONER #8 | TONER #10 | A | A | B | B | A | A | A | A | A | A |

(Symbol "NO" denotes that the toner is not used.)

As shown in Table 10, the values of saturation ΔEab of TONERs #8 and #10 were not higher than 5, and were good. Table 11 shows the density unevenness of printed images when only TONER #8 was used and when only TONER #10 was used. Symbol "NO" denotes that the toner was not used. Table 12 shows the density unevenness of printed images when TONER #8 and TONER #10 were used in combination. As is clear from Table 12, TONER #10 was used for image portions having print duties not higher than 70%, and TONER #8 was used for image portions having print duties higher than 70%. Combining TONERs #8 and #10 in this manner provided good print results. In this manner, use of coloring agents other than carbon black provides as good a print quality as EXAMPLE #1.

TABLE 14

| TONERs | a* | B* | ΔEab |
|---|---|---|---|
| TONER #8 | 3.5 | 2.0 | 4.0 |
| TONER #11 | 1.8 | −0.5 | 1.9 |

(Print duty = 100%)

TABLE 15

| BLACK SECTION | GRAY SECTION | PRINT DUTY (%)/DENSITY UNEVENNESS 10% | 20% | 30% | 40% | 50% | 60% | 70% | 80% | 90% | 100% |
|---|---|---|---|---|---|---|---|---|---|---|---|
| TONER #8 | | A | A | A | B | B | C | C | A | A | A |
| | TONER #11 | A | A | A | A | A | B | B | A | A | A |

EXAMPLE #3

Figure 9:
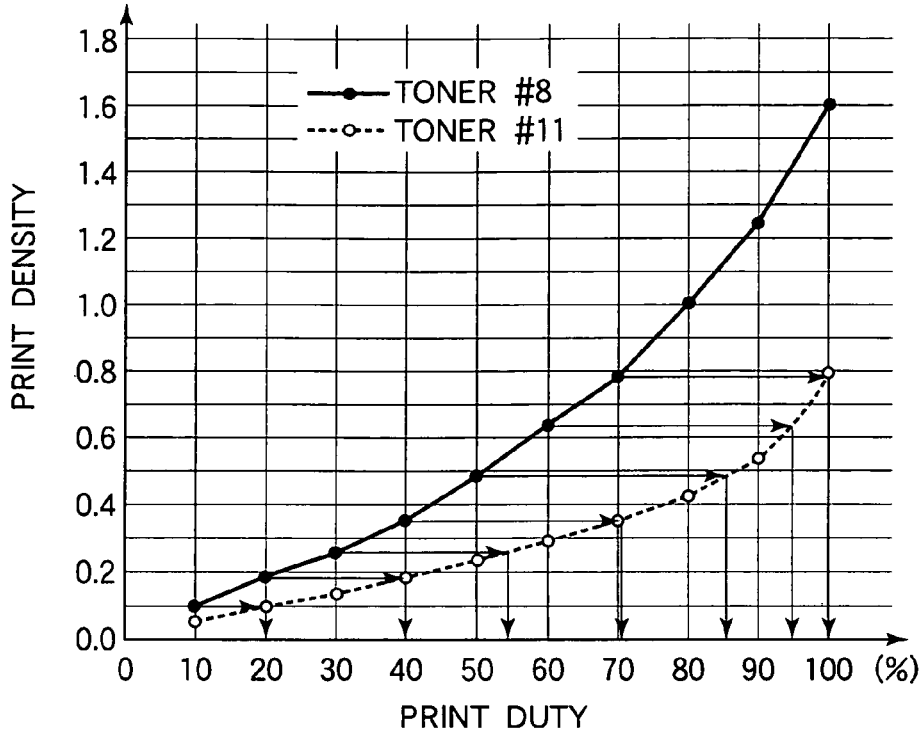
FIG. 9 plots the results shown in Table 13.

Experiments were conducted in the same way as EXAMPLE #1 except that TONER #11 was used to measure the density and hue of printed images, thereby determining the density unevenness of the printed images. The results are shown in Tables 13, 14, 15, and 16. FIG. 9 plots the results shown in Table 13.

TABLE 13

| BLACK SECTION | GRAY SECTION | PRINT DUTY (%)/PRINT DENSITY 10% | 20% | 30% | 40% | 50% | 60% | 70% | 80% | 90% | 100% |
|---|---|---|---|---|---|---|---|---|---|---|---|
| TONER #8 | | 0.10 | 0.18 | 0.26 | 0.36 | 0.48 | 0.63 | 0.77 | 0.99 | 1.23 | 1.60 |
| | TONER #11 | 0.06 | 0.10 | 0.15 | 0.18 | 0.23 | 0.29 | 0.36 | 0.43 | 0.54 | 0.79 |

TABLE 16

| BLACK SECTION | GRAY SECTION | PRINT DUTY (%)/DENSITY UNEVENNESS | | | | | | | | | |
|---|---|---|---|---|---|---|---|---|---|---|---|
| | | 10% | 20% | 30% | 40% | 50% | 60% | 70% | 80% | 90% | 100% |
| TONER #8 | | NO | NO | NO | NO | NO | NO | NO | 80% | 90% | 100% |
| | TONER #11 | 20% | 38% | 54% | 70% | 83% | 93% | 99% | NO | NO | NO |
| TONER #8 | TONER #11 | A | A | B | B | A | A | A | A | A | A |

(Symbol "NO" denotes that the toner is not used.)

As shown in Table 14, the values of saturation ΔEab of TONER #11 were not higher than 5, and were good. Table 15 shows values of the density unevenness of printed images when only TONER #8 was used and when only TONER #10 was used. Table 16 shows values of the density unevenness of printed images when TONER #8 and TONER #11 were used in combination. As is clear from Tables 15 and 16, using TONER #11 improves the image quality for image portions having print duties not higher than 70%, and using TONER #8 improves the image quality for image portions having print duties higher than 70%. Combining TONERs #8 and #10 in this manner provided good print results. The saturation ΔEab may be reduced by adding an amount of cyan pigment to TONER #11 so that the shade of the printed image is more black, i.e., EXAMPLE #3 provides a better monochrome image than EXAMPLE #2.

COMPARISON #2

Figure 10:
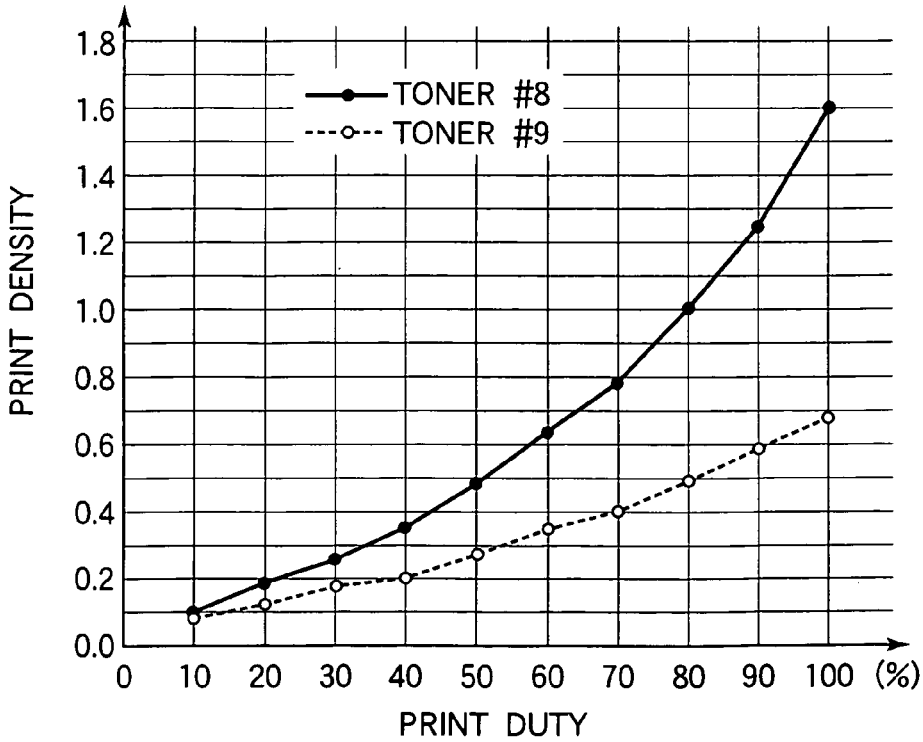
FIG. 10 plots the results shown in Table 17.
Figure 11:
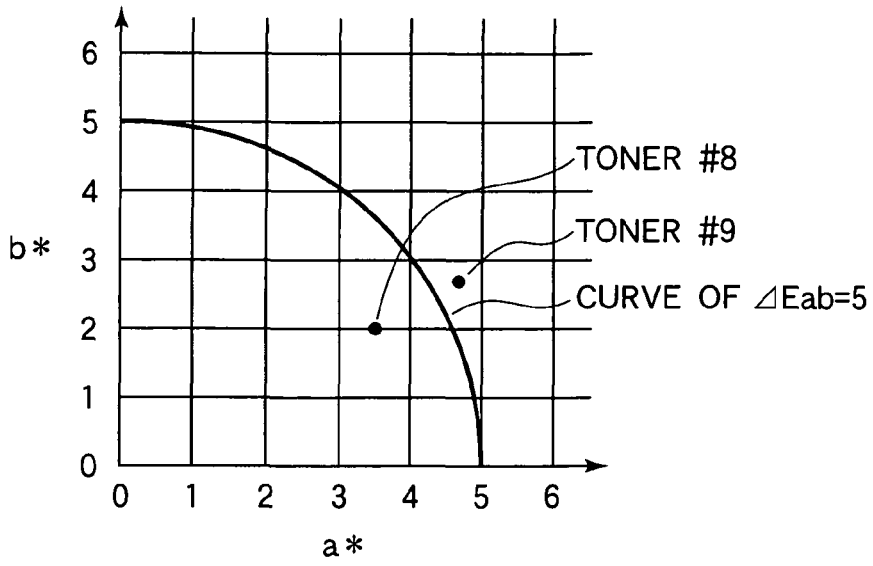
FIG. 11 plots the results shown in Table 18.

Experiments were conducted in the same way as EXAMPLE #2 except that TONER #9 was used to measure the density and hue of printed images, thereby determining the density unevenness of the printed images. The results are shown in Tables 17, 18, and 19. FIG. 10 plots the results shown in Table 17. FIG. 11 plots the results shown in Table 18.

As is clear from the values of saturation ΔEab of hue shown in Table 18 and FIG. 11, TONER #9 exhibits values of saturation ΔEab higher than 5, so that the shades of color of the printed images are brownish. For solving this problem, images were printed by combining TONER #8 with TONER #9 just as described with reference to Table 5 in EXAMPLE #1. The continuity of the shades of color is lost at the boundaries of combined toners, the printed image being an unacceptable monochrome image.

EXAMPLE #4

Figure 12:
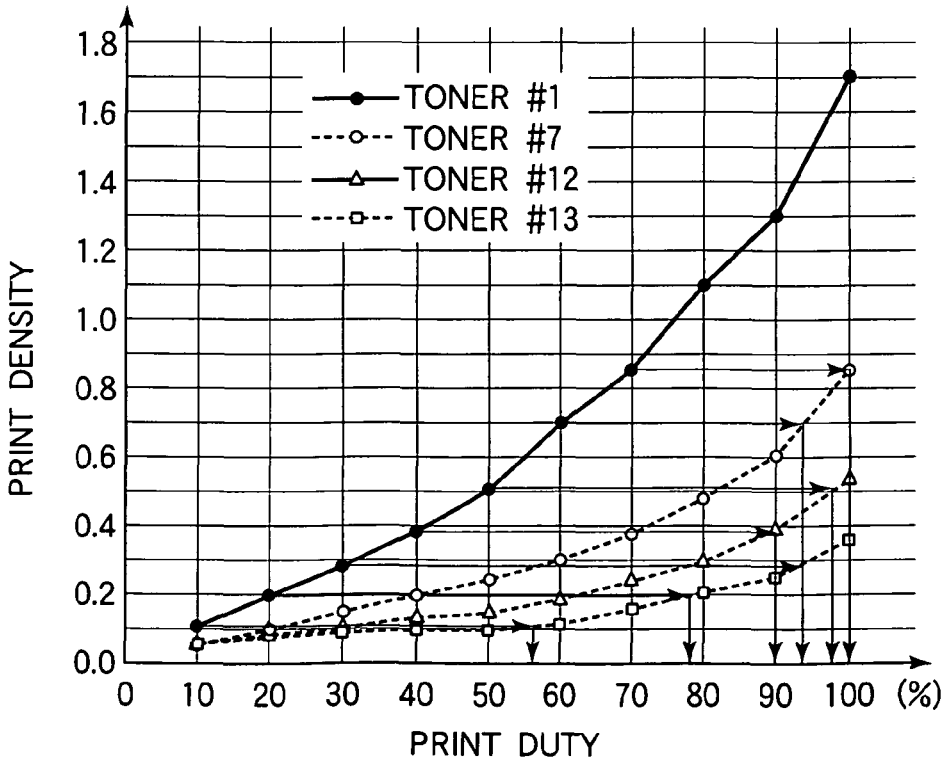
FIG. 12 plots the results shown in Table 20.

Experiments were conducted in the same way as EXAMPLE #1 except that TONERs #1, #7, #12, and #13 were used to measure the density and hue of printed images, thereby determining the density unevenness of the printed images. The results are shown in Tables 20, 21, and 22. FIG. 12 plots the results shown in Table 20.

TABLE 17

| BLACK SECTION | GRAY SECTION | PRINT DUTY (%)/PRINT DENSITY | | | | | | | | | |
|---|---|---|---|---|---|---|---|---|---|---|---|
| | | 10% | 20% | 30% | 40% | 50% | 60% | 70% | 80% | 90% | 100% |
| TONER #8 | | 0.10 | 0.18 | 0.26 | 0.36 | 0.48 | 0.63 | 0.77 | 0.99 | 1.23 | 1.60 |
| | TONER #9 | 0.08 | 0.13 | 0.18 | 0.21 | 0.27 | 0.35 | 0.41 | 0.49 | 0.59 | 0.67 |

TABLE 18

| TONER | a* | B* | ΔEab |
|---|---|---|---|
| TONER #8 | 3.5 | 2.0 | 4.0 |
| TONER #9 | 4.7 | 2.7 | 5.4 |

(Print duty = 100%)

TABLE 19

| GRAY SECTION | PRINT DUTY (%)/DENSITY ENEVENESS | | | | | | | | | |
|---|---|---|---|---|---|---|---|---|---|---|
| | 10% | 20% | 30% | 40% | 50% | 60% | 70% | 80% | 90% | 100% |
| TONER #8 | A | A | A | B | B | C | C | A | A | A |
| TONER #9 | A | A | A | A | A | B | B | A | A | A |

TABLE 20

| BLACK SECTION | GRAY SECTION | PRINT DUTY (%)/PRINT DENSITY | | | | | | | | | |
|---|---|---|---|---|---|---|---|---|---|---|---|
| | | 10% | 20% | 30% | 40% | 50% | 60% | 70% | 80% | 90% | 100% |
| TONER #1 | | 0.11 | 0.19 | 0.28 | 0.38 | 0.51 | 0.69 | 0.85 | 1.09 | 1.31 | 1.70 |
| | TONER #7 | 0.06 | 0.11 | 0.15 | 0.19 | 0.24 | 0.30 | 0.37 | 0.47 | 0.61 | 0.86 |
| | TONER #12 | 0.06 | 0.08 | 0.11 | 0.13 | 0.15 | 0.18 | 0.24 | 0.29 | 0.38 | 0.53 |
| | TONER #13 | 0.06 | 0.07 | 0.08 | 0.09 | 0.10 | 0.12 | 0.16 | 0.21 | 0.25 | 0.36 |

TABLE 21

| TONER | a* | B* | ΔEab |
|---|---|---|---|
| TONER #1 | 2.5 | 3.4 | 4.2 |
| TONER #7 | 2.2 | 2.8 | 3.6 |
| TONER #12 | 2.0 | 2.3 | 3.0 |
| TONER #13 | 1.9 | 1.9 | 2.7 |

(Print duty = 100%)

TABLE 22

| BLACK SECTION | GRAY SECTION | PRINT DENSITY (%)/DENSITY UNEVENNESS | | | | | | | | | |
|---|---|---|---|---|---|---|---|---|---|---|---|
| | | 10% | 20% | 30% | 40% | 50% | 60% | 70% | 80% | 90% | 100% |
| TONER #1 | | A | A | A | B | B | C | C | A | A | A |
| | TONER #7 | A | A | A | A | A | B | B | A | A | A |
| | TONER #12 | A | A | A | B | B | A | A | A | A | A |
| | TONER #13 | A | A | A | A | A | A | A | A | A | A |

TONERs #1, #7, #12, and #13 were related in density proportion as follows:

TONER #1: 1.0

TONER #7: 0.506

TONER #12: 0.312

TABLE 23

| BLACK SECTION | GRAY SECTION | PRINT DUTY (%)/DENSITY UNEVENNESS | | | | | | | | | |
|---|---|---|---|---|---|---|---|---|---|---|---|
| | | 10% | 20% | 30% | 40% | 50% | 60% | 70% | 80% | 90% | 100% |
| TONER #1 | | NO | NO | NO | NO | NO | NO | NO | 80% | 90% | 100% |
| | TONER #7 | NO | NO | NO | NO | NO | 93% | 100% | NO | NO | NO |
| | TONER #12 | NO | NO | NO | 89% | 100% | NO | NO | NO | NO | NO |
| | TONER #13 | 60% | 78% | 93% | NO | NO | NO | NO | NO | NO | NO |
| TONER #1 | TONER #7 | A | A | A | A | A | A | A | A | A | A |
| | TONER #12 | | | | | | | | | | |
| | TONER #13 | | | | | | | | | | |

(Symbol "NO" denotes that the toner is not used.)

TONER #13: 0.212 where "density proportion" is the ratio of the density of images printed using the TONERs #7, #12, and #13, respectively, to the density of an image printed using TONER #1. Assume that the image printed using TONER #1 was printed at a print duty of 100% as shown in Table 20.

Referring to Table 21, the images printed using TONERs #12 and #13 exhibited the values of saturation ΔEab not higher than 5. This was good.

Halftone printing was further performed to form an image by combining TONERs #1, #7, #12, and #13 such that the combination results in an image having a print density equivalent to that obtained using only TONER #1. The developing devices 101, 102, 103, and 104 operated using TONERs #1, #7, #12, and #13, respectively.

As shown in Table 23, no uneven density was observed by inspection over the entire range of halftone levels. In other words, images having good print quality may be obtained using TONER #13 for image portions having print duties not higher than 30%, TONER #12 for image portions having print duties in the range of 30-50%, TONER #7 for image portions having print duties in the range of 50-70%, and TONER #1 for image portions having print duties higher than 70%.

As described above, the experiments showed that allotting print duties of corresponding developing devices each of which holds a toner of a corresponding density provides images of a better quality than EXAMPLE #1.

The first embodiment has been described with respect to selecting types of toners having different densities after checking the print duty described by print data. Alternatively, the density of a printed image may be measured and then a toner having an optimum density may be selected in accordance with the measured density.

As described above, the image forming apparatus of the first embodiment performs halftone printing by combining a plurality of developing devices each of which uses a toner having a density different from the remaining developing devices. If one of the toners used in the image forming apparatus is a gray toner, a chromatic color agent and a black coloring agent may be added to the gray toner, so that the difference in color between the gray toner and black toner may be reduced to provide halftone images without detectable errors in the shades of gray.

The light output of a light source may vary from dot to dot, so that small diameter dots may cause uneven density in a printed halftone image if only black toner is used. The image forming apparatus of the first embodiment employs developing devices that print images of different densities using gray toners having different densities. The use of a plurality of gray toners having different densities provides good print results without a detectable uneven density, since the developing devices form low density portions of an electrostatic latent image with a relatively large diameter dots which inherently have relatively small variations, i.e., substantially equivalent to the charged area exposed to light almost in its entirety.

The first embodiment has been described in terms of a gray toner to which a cyan pigment (pigment blue 15:3) as a chromatic coloring agent and a black coloring agent are added. The chromatic coloring agent may be a yellow pigment or a magenta pigment depending on the hue of the black coloring agent.

The first embodiment has been described in terms of saturation ΔEab calculated based on the measurement of density of a pattern printed on print paper. Alternatively, the saturation ΔEab may be obtained by directly measuring the density of a toner image.

{Method of Forming a Halftone Image}

Figure 14:
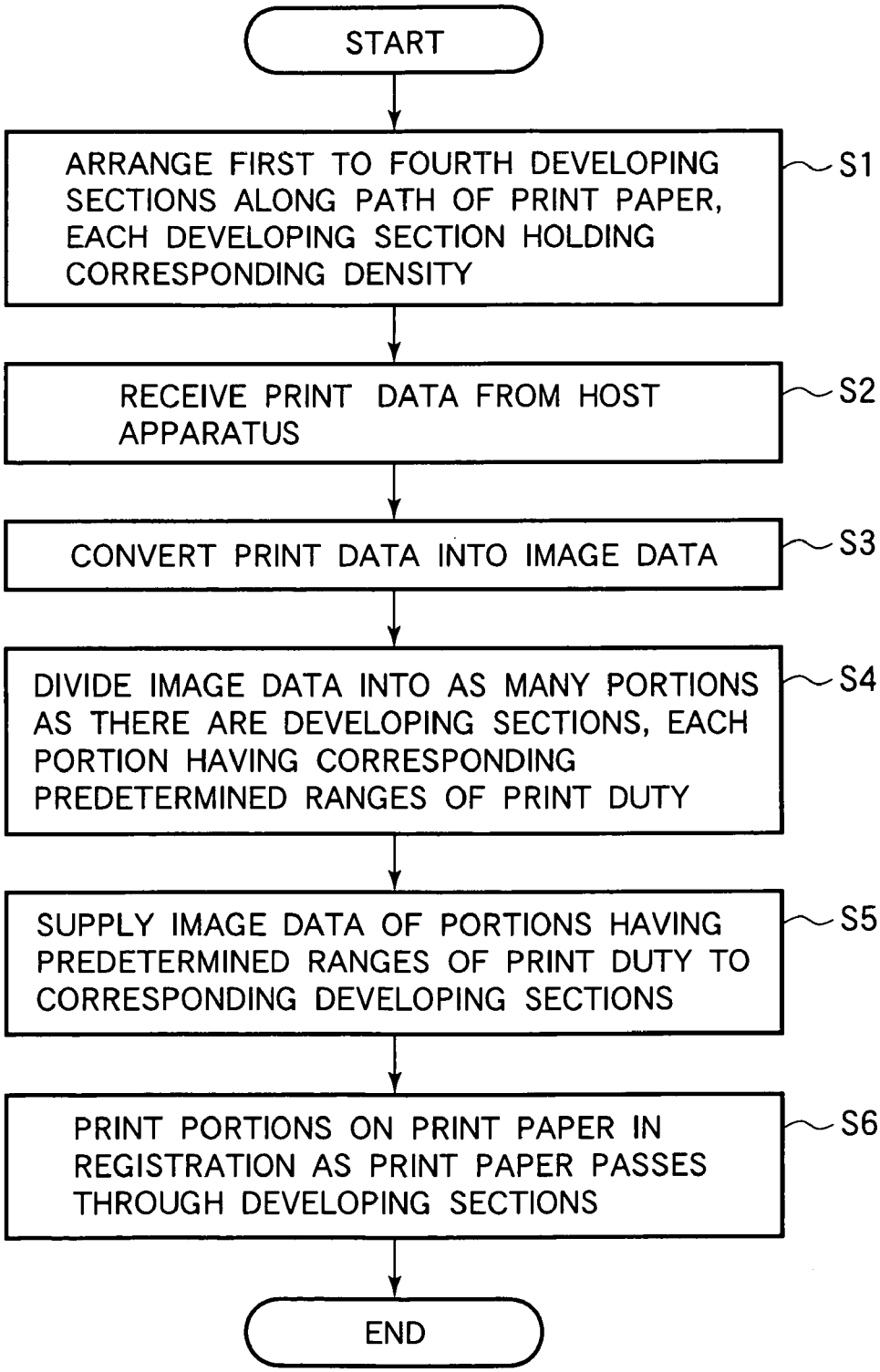
FIG. 14 illustrates a method of forming an image using the present invention.

FIG. 14 illustrates a method of forming an image using the present invention.

A method of forming an image using an image forming apparatus and the developer of the invention will be described with reference to the flowchart illustrated in FIG. 14.

The developing devices are aligned along a path of the print paper and form toner images of corresponding densities (S1). The first developing section holds black toner. The developing devices after the first developing section hold gray developers of corresponding densities of the present invention.

The image forming apparatus receives print data of an image from a host apparatus (S2). The print data is converted into image data (S3). The image data describes the print duty of dots that should be formed on the photoconductive drum. The image data is divided into as many portions as there are the developing devices, each portion covering a corresponding predetermined range of print duty (S4). Each portion of the image data is then supplied to a corresponding developing section (S5).

The developing devices 101-104 are operated to print their corresponding portions of image data (S6). The developing section 101 prints, for example, a first portion of the image in accordance with a first range of print duty of the image. Then, the developing section 102 prints a second portion of the image in accordance with a second range of print duty of the image, the second portion being transferred onto the first portion in registration. Then, the developing section 103 prints a third portion of the image in accordance with a third range of print duty of the image, the third portion being transferred onto the first portion in registration. Finally, the developing section 104 prints a fourth portion of the image in accordance with a fourth range of print duty of the image. In this manner, each of the developing devices prints a corresponding portion of the image having print duties in a corresponding range of print duty in accordance with the image data.

Second Embodiment

Experiments were conducted using the image forming apparatus 100 described in the first embodiment and toners of a second embodiment. The results of the experiments will be described in terms of EXAMPLEs #5-#10 and COMPARISONs #3 to #8.

In the second embodiment, the toner particle diameter of the gray toner is about 70 to 90% of that of the black toner. Combining these two types of toners improves the graininess of halftones in a low-temperature and low-humidity environment which would cause the toner to dry to increase the electrical resistance of the toner, hence impairing the transfer performance of toner images onto print paper during transfer of images onto the print paper and heat transfer to the toner images during fixing. More preferably, the toner particle diameter of the gray toner is about 80 to 90% of that of the black toner, which improves the uniformity of the graininess of halftones.

Toners of Second Embodiment

The toners were manufactured in the same way as TONER #7 except for the proportion of the coloring agent. The pulverized mixture of the first embodiment was melted and kneaded with a twin screw extruder. Then, the kneaded material was cooled, and coarse pulverization of the material was performed using a cutter mill equipped with a screen having a diameter of 2 mm. The thus pulverized material was further pulverized using a dispersion separator (Japan Pneumatic Industry Company Ltd.) as a pulverizer, was then classified using a pneumatic separator to obtain a base toner. The larger the mechanical energy added to the material during pulverization, the smaller the particle diameter is. The mechanical energy may be adjusted by controlling the energy for each collision or increasing the number of collisions. The amount of mechanical energy given to the material for pulverization was controlled to achieve an intended particle diameter, and then classification was performed, thereby obtaining a base toner. Just as in TONER #7, an external additive was added to the base toner to obtain TONER #23.

The average volume mean particle diameter of TONER #23 was 6.0 μm. Likewise, the energy given to the material was gradually increased stepwise during pulverization and classification, thereby obtaining TONERs #14, #24, #15, #16, and #17 having an average volume mean particle diameter of 5.4 μm, 5.2 μm, 4.8 μm, 4.2 μm, and 3.9 μm, respectively.

TONER #22 was manufactured in the same way as TONER #7 except that the energy given to the material during pulverization and classification was reduced. The average volume mean particle diameter of TONER #23 was 6.4 μm. Likewise, the energy given to the material during pulverization and classification was decreased stepwise, thereby obtaining TONERs #18, #21, #20, and #25 corresponding to the values of energy. TONERs #18, #21, #20, and #25 have average volume mean particle diameters of 6.6 μm, 7.2 μm, 8.0 μm, and 8.8 μm, respectively. Also, TONER #19 was manufactured in the same way as TONER #1 except that the energy given to the material during pulverization and classification was reduced compared to TONER #1. The average volume mean particle diameter of TONER #19 was 8.0 μm.

Table 24 lists the average volume mean particle diameters of TONERs #14 to #24 and TONERs #1 and #7.

TABLE 24

| TONERs | DIAMETER (μm) | DIAMETER RATIO TO BLACK TONER | COLORING AGENT (mass parts) |
|---|---|---|---|
| TONER #1 | 6.0 | — | Carbon black = 5.0 |
| TONER #7 | 6.0 | 1.0 | (Carbon |
| TONER #14 | 5.4 | 0.9 | black = 1.0) + (pigment |
| TONER #15 | 4.8 | 0.8 | blue 15:3 = 0.1) |
| TONER #16 | 4.2 | 0.7 | |
| TONER #17 | 3.9 | 0.65 | |
| TONER #18 | 6.6 | 1.1 | |
| TONER #19 | 8.0 | — | Carbon black = 5.0 |
| TONER #20 | 8.0 | 1.0 | (Carbon |
| TONER #21 | 7.2 | 0.9 | black = 1.0) + (pigment |
| TONER #22 | 6.4 | 0.8 | blue 15:3 = 0.1) |
| TONER #23 | 5.6 | 0.7 | |
| TONER #24 | 5.2 | 0.65 | |
| TONER #25 | 8.8 | 1.1 | |

Using TONERs #1, #7, and #14 to #25, experiments were conducted in a more hostile environment than EXAMPLE #1 of the first embodiment, i.e., an environment of 10° C. and 10% RH instead of 23° C. and 40% RH. In such a low temperature/low humidity environment, the electrical resistance of print paper increases so that transfer of toner images is usually difficult during the transfer process and heat is usually difficult to transfer to the print paper during the fixing process.

Halftone printing was performed in the aforementioned environment (10° C./10% RH) using the developing section 101 for black. An image was printed using TONER #1, and the printed image was referred to as SAMPLE #1.

EXAMPLE 5

Halftone printing was performed in the same way as EXAMPLE #1 using the developing section 101 that holds TONER #1 and the developing section 102 that holds TONER #14. The results similar to those shown in Table 2 were obtained. In other words, TONER #14 exhibited the test results similar to TONER #7 shown in Table 2. Then, printing was performed just as in the experiment described with reference to Table 5 of EXAMPLE #1. The printing was performed using TONER #1 for image portions having print duties in the range of 80-100% and TONER #14 for image portions having print duties in the range of 10-70%, thereby obtaining SAMPLE #2.

SAMPLE #1 and SAMPLE #2 were compared with each other. For an electrostatic latent image having print duties not higher than 50%, the graininess of halftone was better in SAMPLE #3 than in SAMPLE #1. No toner adhering to the margin area (i.e., an area surrounding a printable area of the paper) of a page of print paper was observed. Table 25 shows the results of the experiments. Graininess is a measure of how an electrostatic latent image formed on the photoconductive drum is actually reproduced in an image printed on a print paper, dots having a sharply defined dot shape without toner mess around the dots.

TABLE 25

| EXAMPLEs | COMBINATION OF TONERs | | HALFTONE RESULTS |
|---|---|---|---|
| EXAMPLE #5 | TONER #1 | TONER #14 | AA |
| EXAMPLE #6 | TONER #1 | TONER #15 | AA |
| EXAMPLE #7 | TONER #1 | TONER #16 | BB |
| COMPARISON #3 | TONER #1 | TONER #17 | CC |
| COMPARISON #4 | TONER #1 | TONER #7 | DD |

TABLE 25-continued

| EXAMPLEs | COMBINATION OF TONERs | | HALFTONE RESULTS |
|---|---|---|---|
| COMPARISON #5 | TONER #1 | TONER #18 | EE |
| EXAMPLE #8 | TONER #19 | TONER #21 | AA |
| EXAMPLE #9 | TONER #19 | TONER #22 | AA |
| EXAMPLE #10 | TONER #19 | TONER #23 | BB |
| COMPARISON #6 | TONER #19 | TONER #24 | CC |
| COMPARISON #7 | TONER #19 | TONER #20 | DD |
| COMPARISON #8 | TONER #19 | TONER #25 | EE |

AA: Good

BB: A limited number of dots of a screen line was missed but was not detectable by inspection.

CC: A large number of dots of a screen line was missed.

DD: A small amount of toner mess was observed in the vicinity of dots of a screen line.

EE: Toner mess was observed in the vicinity of dots of a screen line. The shape of dots was not uniform. The image quality was poor.

EXAMPLE #6

Halftone printing was performed in the same way as EXAMPLE #1 using the developing section 101 that holds TONER #1 and the developing section 102 that holds TONER #15. The results similar to those shown in Table 2 were obtained. In other words, TONER #15 exhibited test results similar to those of TONER #7 shown in Table 2. Then, printing was performed just as in the experiment described with reference to Table 5 of EXAMPLE #1. The printing was performed using TONER #1 for image portions having print duties in the range of 80-100% and TONER #15 for image portions having print duties in the range of 10-70%, thereby obtaining SAMPLE #3.

SAMPLE #1 and SAMPLE #3 were compared with each other.

For an electrostatic latent image having print duties not higher than 50%, the graininess of halftone was better in SAMPLE #3 than in SAMPLE #1. No toner adhering to the margin area of the print paper was observed. Table 25 shows the results.

EXAMPLE #7

Halftone printing was performed in the same way as EXAMPLE #1 using the developing section 101 that holds TONER #1 and the developing section 102 that holds TONER #16. The results similar to those shown in Table 2 were obtained. In other words, TONER #16 exhibited test results similar to those of TONER #7 shown in Table 2. Then, printing was performed just as in the experiment described with reference to Table 5 of EXAMPLE #1. The printing was performed using TONER #1 for image portions having print duties in the range of 80-100% and TONER #16 for image portions having print duties in the range of 10-70%, thereby obtaining SAMPLE #4.

SAMPLE #1 and SAMPLE #4 were compared with each other. For an electrostatic latent image having print duties not higher than 50%, the graininess of halftone was better in SAMPLE #4 than in SAMPLE #1. No toner adhering to the margin area of the print paper was observed. However, observation under a loupe revealed that a limited part of the image lost the dots of a screen line of a halftone though they were not detectable by inspection. Table 25 shows the results.

COMPARISON #3

Halftone printing was performed in the same way as EXAMPLE #1 using the developing section 101 that holds TONER #1 and the developing section 102 that holds TONER #17. The results similar to those shown in Table 2 were obtained. In other words, the test results of TONER #17 were similar to those of TONER #7 shown in Table 2. Then, printing was performed just as in the experiment described with reference to Table 5 of EXAMPLE #1. The printing was performed using TONER #1 for image portions having print duties in the range of 80-100% and TONER #17 for image portions having print duties in the range of 10-70%, thereby obtaining SAMPLE #5.

SAMPLE #1 and SAMPLE #5 were compared with each other. For an electrostatic latent image having print duties not higher than 50%, the graininess of halftone was poor in SAMPLE #4 compared to SAMPLE #1, showing poor smoothness in halftones. Observation under a loupe showed that part of the image was missing the dots of a screen line of a halftone. Table 25 shows the results.

This appears to be due to poor transfer performance caused by the fact that if dot diameters are small, the adhesion between the toner and the photoconductive drum overcomes the electric force that transfers the toner from the photoconductive drum onto the print paper, causing insufficient transfer performance.

Toner was absent from some image areas of the printed image, while some toner was observed on a margin area in which the toner should not be present. This may be due to poor transfer performance. The smaller the diameter of a toner particle is, the larger the surface area of the toner particle per unit weight is. The volume of air among toner particles increases, preventing smooth heat transfer so that the amount of heat given to the toner decreases. This causes "low temperature offset" in which the toner having poor adhesion to the paper becomes detached from the print paper. The toner detached from the print paper appears to adhere to the surface of the fixing rollers (heat roller 10 and pressure roller 12), and then the toner on the surface of the fixing rollers appears to adhere to the margin area of the print paper.

COMPARISON #4

Halftone printing was performed in the same way as EXAMPLE #1 with the developing section 101 that holds TONER #1 and the developing section 102 that holds TONER #6. The printing was performed just as in the experiment described with reference to Table 5 of EXAMPLE #1. In other words, the printing was performed using TONER #1 for image portions having print duties in the range of 80-100% and TONER #7 for image portions having print duties in the range of 10-70%, thereby obtaining SAMPLE #6.

SAMPLE #1 and SAMPLE #6 were compared with each other. For an electrostatic latent image having print duties not higher than 50%, the graininess of halftone was somewhat poor in SAMPLE #6 compared to SAMPLE #1, the graininess being detectable by inspection. Observation under a loupe showed that a little toner mess was present around the dots of a screen line of a halftone. No deposition of toner was observed in the non-printable area or a margin area of the print paper. Table 25 shows the results. The results may be due to poor transfer performance. For substantially the same toner particle diameter, the electrical resistance of toner particles is higher in the gray toner than in the black toner. The proportion of TONER #7 to TONER #1 is small, so that if the toner particles have substantially the same diameter, the electrical resistance of the gray toner is higher than that of the black toner. This causes poor transfer performance.

COMPARISON #5

Halftone printing was performed in the same way as EXAMPLE #1 using the developing section 101 that holds TONER #1 and the developing section 102 that holds TONER #18. The printing was performed just as in the experiment described with reference to Table 5 of EXAMPLE #1. In other words, the printing was performed using TONER #1 for image portions having print duties in the range of 80-100% and TONER #18 for image portions having print duties in the range of 10-70%, thereby obtaining SAMPLE #7.

SAMPLE #1 and SAMPLE #7 were compared with each other. For an electrostatic latent image having print duties not higher than 50%, the graininess of halftone was somewhat poor in SAMPLE #7 compared to SAMPLE #1, the graininess being detectable by inspection. Observation under a loupe showed that toner mess occurred in the vicinity of the dots of a screen line of a halftone. The shape of the dots was not uniform. Table 25 shows the results. The results may be due to the fact that TONER #18 has a larger particle diameter than TONER #1. Thus, the electrostatic latent image was not faithfully developed with TONER #18.

Using TONER #19, an experiment was conducted in a more hostile environment than EXAMPLE #1 of the first embodiment, i.e., an environment of 10° C. and 10% RH instead of 23° C. and 40% RH. Only the developing section 101 that holds TONER #19 was operated, thereby obtaining SAMPLE #8.

EXAMPLE #8

Halftone printing was performed in the same way as EXAMPLE #1 with the developing section 101 that holds TONER #19 and the developing section 102 that holds TONER #21. The results similar to those shown in Table 2 were obtained. In other words, TONERs #19 and #21 exhibited test results similar to those of TONER #1 and TONER #7, respectively, shown in Table 2. Then, printing was performed just as in the experiment described with reference to Table 5 of EXAMPLE #1. The printing was performed using TONER #19 for image portions having print duties in the range of 80-100% and TONER #21 for image portions having print duties in the range of 10-70%, thereby obtaining SAMPLE #9.

SAMPLE #8 and SAMPLE #9 were compared with each other. For an electrostatic latent image having print duties not higher than 50%, the graininess of halftone was somewhat better in SAMPLE #9 than in SAMPLE #8. No toner deposited to the margin areas of a page of the print paper was observed. Table 25 shows the results.

EXAMPLE #9

Halftone printing was performed in the same way as EXAMPLE #1 using the developing section 101 that holds TONER #19 and the developing section 102 that holds TONER #22. The results similar to those shown in Table 2 were obtained. In other words, TONER #19 exhibited test results similar to those of TONER #7 shown in Table 2. Then, printing was performed just as in the experiment described with reference to table 5 of EXAMPLE #1. The printing was performed using TONER #19 for image portions having print duties in the range of 80-100% and TONER #22 for image portions having print duties in the range of 10-70%, thereby obtaining SAMPLE #10.

SAMPLE #8 and SAMPLE #10 were compared with each other. For an electrostatic latent image having print duties not higher than 50%, the graininess of halftone was somewhat better in SAMPLE #10 than in SAMPLE #8. No toner adhering to the margin area of a page of the print paper was observed. Table 25 shows the results.

EXAMPLE #10

Halftone printing was performed in the same way as EXAMPLE #1 using the developing section 101 that holds TONER #19 and the developing section 102 that holds TONER #23. The results similar to those shown in Table 2 were obtained. In other words, TONER #23 exhibited test results similar to those of TONER #7 shown in Table 2. Then, printing was performed just as in the experiment described with reference to Table 5 of EXAMPLE #1. The printing was performed using TONER #19 for image portions having print duties in the range of 80-100% and TONER #23 for image portions having print duties in the range of 10-70%, thereby obtaining SAMPLE #11.

SAMPLE #8 and SAMPLE #11 were compared with each other. For an electrostatic latent image having print duties not higher than 50%, the graininess of halftone was somewhat better in SAMPLE #11 than in SAMPLE #8. However, observation under a loupe showed that part of the image was missing the dots of a screen line of a halftone though they were not detectable by inspection. No toner deposition to the margin area of the print paper was observed. Table 25 shows the results.

COMPARISON #6

Halftone printing was performed in the same way as EXAMPLE #1 using the developing section 101 that holds TONER #19 and the developing section 102 that holds TONER #24. The results similar to those shown in Table 2 were obtained. In other words, TONER #24 exhibited test results similar to those of TONER #7 shown in Table 2. Then, printing was performed just as in the experiment described with reference to Table 5 of EXAMPLE #1. The printing was performed using TONER #19 for image portions having print duties in the range of 80-100% and TONER #24 for image portions having print duties in the range of 10-70%, thereby obtaining SAMPLE #12.

SAMPLE #8 and SAMPLE #12 were compared with each other. For an electrostatic latent image having print duties not higher than 50%, the graininess of halftone was somewhat poor in SAMPLE #12 compared to SAMPLE #8, showing poor smoothness in halftone. Observation under a loupe showed that part of the image was missing the dots of a screen line of a halftone. Table 25 shows the results.

This appears to be due to poor transfer performance caused by the fact that if dot diameters are small, the adhesion between the toner and the photoconductive drum overcomes the electric force that transfers the toner from the photoconductive drum onto the print paper.

The toner was absent from image areas while some toner was observed in margin areas in which the toner should not be present. This appears to be due to poor transfer performance. The smaller the diameter of a toner particle is, the larger the surface area of the toner particle per unit weight is so that the air gaps among toner particles increases. The increased gaps impair heat transfer, reducing the amount of heat given to the toner. This causes "low-temperature offset" in which the toner loses its adhesion and becomes detached from the paper. The toner detached from the paper adheres to the surfaces of the fixing rollers (heat roller 10 and pressure roller 12), and then the toner on the surface of the fixing rollers adheres to the margin area of the print paper.

COMPARISON #7

Halftone printing was performed in the same way as EXAMPLE #1 using the developing section 101 that holds TONER #19 and the developing section 102 that holds TONER #20. In other words, the printing was performed just as in the experiment described with reference to Table 5 of EXAMPLE #1. The printing was performed using TONER #19 for image portions having print duties in the range of 80-100% and TONER #20 for image portions having print duties in the range of 10-70%, thereby obtaining SAMPLE #13.

SAMPLE #8 and SAMPLE #13 were compared with each other. For an electrostatic latent image having print duties not higher than 50%, SAMPLE #13 showed a somewhat poor graininess of halftone compared to SAMPLE #8, the poor graininess being detectable by inspection. Observation under a loupe showed that toner mess occurred in the vicinity of screen line of halftone. No toner deposition to the margin area of the print paper was observed. Table 25 shows the results. If the toner particles have substantially the same diameter, the electrical resistance of toner particles is higher in the gray toner than in the black toner because TONER #20 contains a smaller amount of a coloring agent than TONER #19. The above results appear to be due to poor transfer performance caused by the gray toner having a higher electrical resistance.

COMPARISON #8

Halftone printing was performed in the same way as EXAMPLE #1 using the developing section 101 that holds TONER #19 and the developing section 102 that holds TONER #25. In other words, the printing was performed just as in the experiment described with reference to Table 5 of EXAMPLE #1. The printing was performed using TONER #19 for image portions having print duties in the range of 80-100% and TONER #25 for image portions having print duties in the range of 10-70%, thereby obtaining SAMPLE #14.

SAMPLE #8 and SAMPLE #14 were compared with each other. For an electrostatic latent image having print duties not higher than 50%, SAMPLE #14 showed somewhat poor graininess of halftone compared to SAMPLE #8, the poor graininess being detectable by inspection. Observation under a loupe showed that toner mess occurred in the vicinity of screen line of halftone. The shape of dots was not uniform. No toner deposition to the margin area of the print paper was observed. Table 25 shows the results. The aforementioned results appear to be due to poor development performance caused by the fact that TONER #25 has a larger particle diameter than TONER #19 so that the electrostatic latent image was not developed faithfully.

Third Embodiment

Experiments were conducted using the image forming apparatus 100 described in the first embodiment and toners of a third embodiment. The results of the experiments will be described in terms of EXAMPLEs #11-#14 and COMPARISONs #9 to #12.

In the third embodiment, printing was performed using a black toner and a gray toner that has a larger amount of external additive than the black toner. Therefore, after continuous printing, no paper soiling was deteriorated and good printed images of halftone were obtained. The amount of the external additive of gray toner was in the range of 1.1 to 1.3 of that of black toner, thereby preventing poor fixing results.

A base toner was obtained in the same process as the TONER #1. An amount of 3.3 mass parts of hydrophobic silica R972 as an external additive (average primary particle diameter of 16 nm, available from NIPPON AEROSIL CO., Ltd.) was added to the base toner of 1 kg (100 mass parts), and was then agitated for 3 minutes in a Henschel mixer, thereby obtaining TONER #26. The average volume mean particle diameter of TONER #26 was 6.0 μm.

TONER #27 was manufactured in the same way as TONER #26 except that 3.6 mass parts of hydrophobic silica R972 was added externally. The average volume mean particle diameter of TONER #27 was 6.0 μm.

TONER #28 was manufactured in the same way as TONER #26 except that 4.2 mass parts of hydrophobic silica R972 was added externally. The average volume mean particle diameter of TONER #28 was 6.0 μm.

TONER #29 was manufactured in the same way as TONER #26 except that 2.4 mass parts of hydrophobic silica R972 was added externally. The average volume mean particle diameter of TONER #29 was 6.0 μm.

A base toner was obtained in the same process as the TONER #7. An amount of 3.3 mass parts of hydrophobic silica R972 as an external additive (average primary particle diameter of 16 nm, available from NIPPON AEROSIL CO., Ltd.) was added to the base toner of 1 kg (100 mass parts), and was then agitated for 3 minutes in a Henschel mixer, thereby obtaining TONER #30. The average volume mean particle diameter of TONER #30 was 6.0 μm.

TONER #31 was manufactured in the same way as TONER #30 except that 3.6 mass parts of hydrophobic silica R972 was added externally. The average volume mean particle diameter of TONER #31 was 6.0 μm.

TONER #32 was manufactured in the same way as TONER #30 except that 3.9 mass parts of hydrophobic silica R972 was added externally. The average volume mean particle diameter of TONER was 6.0 μm.

TONER #33 was manufactured in the same way as TONER #30 except that 4.2 mass parts of hydrophobic silica R972 was added externally. The average volume mean particle diameter of TONER was 6.0 μm.

TONER #34 was manufactured in the same way as TONER #30 except that 4.5 mass parts of hydrophobic silica R972 was added externally. The average volume mean particle diameter of TONER #34 was 6.0 μm.

TONER #35 was manufactured in the same way as TONER #30 except that 2.4 mass parts of hydrophobic silica R972 was added externally. The average volume mean particle diameter of TONER #35 was 6.0 μm.

Table 26 lists the amounts of hydrophobic silica R972 externally added to TONERs #26-#35.

TABLE 26

| TONERs | Amount of Silica R972 (mass parts) | Ratio of amount of additive | Coloring agent (mass parts) |
|---|---|---|---|
| TONER #1 | 3.0 | | Carbon |
| TONER #26 | 3.3 | 1.1 | black = 5.0 |
| TONER #27 | 3.6 | 1.2 | |
| TONER #28 | 4.2 | 1.4 | |
| TONER #29 | 2.4 | 0.8 | |
| TONER #7 | 3.0 | 1.0 | (Carbon |
| TONER #30 | 3.3 | 1.1 | black = 1.0) + |
| TONER #31 | 3.6 | 1.2 | (pigment blue |
| TONER #32 | 3.9 | 1.3 | 15:3 = 0.1) |
| TONER #33 | 4.2 | 1.4 | |
| TONER #34 | 4.5 | 1.5 | |
| TONER #35 | 2.4 | 0.8 | |

("Ratio of amount of additive" is the ratio of the amount of an external additive added to the respective toner to that added to TONER #1.)

Testing of soiling of the surface of the photoconductive drum will be described.

Printing was performed under the following conditions using only the developing section 101 attached to the image forming apparatus 100.

(1) A4 size paper (OKI, excellent white paper having a basic weight of 80 g/m$^2$) was used as print paper. Printing was performed on a surface of the print paper opposite to that appearing when the package of a stack of the print paper is unsealed. The print paper was transported in a portrait orientation.

(2) The surface temperature of the heat roller 10 of the fixing section 105 was set to 175° C.

(3) The printing speed was 250 mm/s.

A test patch having a print duty of 0.3% was printed on the print paper. A total of 5000 pages of print paper were advanced with an interpage gap of 60 mm. After having printed on 5000 pages, the same test patch having a print duty of 0.3% was printed on one page of paper. Assume that the print paper is passing a transfer point defined between the photoconductive drum 1 and the transfer belt 16. When an unexposed area on the photoconductive drum 1 was downstream of the developing roller 4 and the transfer point, the photoconductive drum 1 was stopped. Then, a piece of SCOTCH TAPE (810-3-18, available from 3M) was affixed on the non-exposed area and was then peeled off the photoconductive drum 1. The peeled piece of SCOTCH TAPE was affixed to the A4 size paper. This tape is named as TAPE A. Another fresh, unused piece of SCOTCH TAPE was affixed to A4 size paper. This tape is named as TAPE B.

The color difference ΔE between TAPE A and TAPE B was measured with a colorimeter (Model CM-2600d available from KONICA MINOLTA, C light source, field of view of 2 degrees, regular reflection SCE, aperture of 8 mm). The color difference ΔE was 1.5.

Likewise, printing was performed using the developing section 101 and TONER #26 to #35 and TONER #7 to evaluate the soiling of the photoconductive drum 1. Table 27 lists the color difference ΔE.

TABLE 27

| TONERs | Ratio of amount of additive | Color difference, ΔE |
|---|---|---|
| TONER #1 | — | 1.5 |
| TONER #26 | 1.1 | 1.8 |
| TONER #27 | 1.2 | 2.2 |
| TONER #28 | 1.4 | 2.6 |
| TONER #29 | 0.8 | 0.2 |
| TONER #7 | 1.0 | 0.5 |
| TONER #30 | 1.1 | 0.5 |
| TONER #31 | 1.2 | 0.5 |
| TONER #32 | 1.3 | 0.6 |
| TONER #33 | 1.4 | 0.6 |
| TONER #34 | 1.5 | 0.6 |
| TONER #35 | 0.8 | 0.4 |

("Ratio of amount of additive" is the ratio of the amount of an external additive added to the respective toner to that added to TONER #1.)

Since the soiling on the photoconductive drum 1 was measured, the color difference ΔE is called "drum soiling". "Drum soiling" is expressed in terms of the amount of toner deposited on the non-exposed area of the photoconductive drum 1. Therefore, the larger the value of ΔE is, the larger the amount of toner is deposited or the toner particles are noticeable. The toner deposited on the non-exposed area appears to be transferred onto the print paper paper, impairing print quality. For improving the print quality, drum soiling should be minimized.

Table 27 reveals that the larger the amount of an external additive is, the larger the drum soiling is. This appears due to the fact that increasing the amount of an external additive makes the toner particles flowable as opposed to toner particles to which a smaller amount of an external additive is added. The increased flowability prevents the toner particles from being sufficiently charged triboelectrically. This causes a larger amount of the toner to adhere to the non-exposed area on the photoconductive drum 1. The gray toner contains a smaller amount of coloring agent than the black toner, so that the toner particles deposited on the non-exposed area are difficult to see, retarding the increase of drum soiling. Therefore, the amount of an external additive added to the black toner should be less than that of the gray toner.

Printing was performed to evaluate the degree of paper soiling, the quality of halftone image, and the degree of fixing. "Paper soiling" used herein refers to soling of paper due to transfer of toner deposited to the non-exposed area of the photoconductive drum 1. It is to be noted that some of the toner deposited on the non-exposed area of the photoconductive drum 1 may not be transferred onto the print paper due partly to the surface roughness of the print paper. Thus, "paper soiling" is not exactly the same as "drum soling".

Using the developing section 101 that holds a black toner and the developing section 102 that holds a gray toner, a test patch having a print duty of 0.3% was printed on print paper. A total of 5000 pages of print paper were advanced at an interpage gap of 60 mm. After having printed on 5000 pages, printing was performed, as described with reference to Table 5 of EXAMPLE #1, using the black toner for image portions having print duties in the range of 80-100% and the gray toner for image portions having print duties in the range of 10-70%, thereby obtaining print samples.

EXAMPLE #11

Halftone printing was performed using TONER #1 as a black toner and TONER #7 as a gray toner, thereby obtaining SAMPLE #15. Likewise, printing was performed using TONER #1 as a black toner and TONER #30 as a gray toner, thereby obtaining SAMPLE #16.

Table 28 lists the quality of SAMPLEs #15 and #16 evaluated by inspection. The quality of SAMPLEs #15 and #16 was good. Some graininess was observed in the low print duty area of SAMPLE #15. Observation under a loupe revealed that dots of halftone were partially lost. SAMPLE #16 exhibited a sharper halftone than SAMPLE #15.

TABLE 28

| Examples/ Comparisons | Black toner | Gray toner | Ratio of additive | Paper soiling | Halftone | Fixing |
|---|---|---|---|---|---|---|
| Reference | TONER #1 | TONER #7 | 1.0 | Ref. | Ref. | B |
| EXMPL #11 | TONER #1 | TONER #30 | 1.1 | equivalent | BB | B |
| EXMPL #12 | TONER #1 | TONER #31 | 1.2 | equivalent | BB | B |
| EXMPL #13 | TONER #1 | TONER #32 | 1.3 | equivalent | BB | B |
| COMP #9 | TONER #1 | TONER #33 | 1.4 | equivalent | BB | C |
| COMP #10 | TONER #1 | TONER #34 | 1.5 | equivalent | BB | C |
| COMP #11 | TONER #1 | TONER #35 | 0.8 | equivalent | CC | B |
| Reference | TONER #26 | TONER #30 | 1.0 | Ref. | Ref. | B |
| EXMPL #14 | TONER #26 | TONER #33 | 1.28 | equivalent | BB | B |
| COMP #12 | TONER #26 | TONER #34 | 1.37 | equivalent | BB | C |
| Reference | TONER #29 | TONER #35 | 1.0 | Ref. | Ref. | B |
| EXMPL #15 | TONER #29 | TONER #7 | 1.25 | equivalent | BB | B |

BB: A limited number of dots is missed but is not detectable by inspection.
CC: A large number of dots is missed.

EXAMPLE #12

Halftone printing was performed using TONER #1 as a black toner and TONER #31 as a gray toner, thereby obtaining SAMPLE #17. Table 28 shows the quality of SAMPLEs #15 and #17 evaluated by inspection. No difference in paper soiling between SAMPLE #15 and SAMPL #17 was observed, and no soiling was observed. Neither SAMPLE #15 nor SAMPLE #17 showed insufficient fixing results. SAMPLE #17 exhibited a sharper halftone than SAMPLE #15.

EXAMPLE #13

Halftone printing was performed using TONER #1 as a black toner and TONER #32 as a gray toner, thereby obtaining SAMPLE #18. Table 28 shows the comparison results of SAMPLEs #15 and #18 by inspection. No difference in paper soiling between SAMPLE #15 and SAMPL #17 was observed, and no soiling was observed. The results were good. SAMPLE 18 showed a sharper halftone than SAMPLE #15.

COMPARISON #9

Halftone printing was performed using TONER #1 as a black toner and TONER #33 as a gray toner, thereby obtaining SAMPLE #19. Table 28 shows the comparison results of SAMPLEs #15 and #19 evaluated by inspection. SAMPLE #19 showed a sharper halftone than SAMPLE #15.

However, soiling caused by gray toner was observed on the print paper of SAMPLE #19 after fixing. The soiling was caused by the fact that some of the toner moves from the print paper to the fixing roller during fixing and then moves back onto the print paper after one complete rotation of the fixing roller. Such a phenomenon is due to the fact that too large an amount of the external additive added to the gray toner was detrimental to the fusing of the toner into the print paper.

COMPARISON #10

Halftone printing was performed using TONER #1 as a black toner and TONER #34 as a gray toner, thereby obtaining SAMPLE #20. Table 28 shows the quality of SAMPLEs #15 and #20 evaluated by inspection. No difference in paper soiling between SAMPLE #15 and SAMPLE #20 was observed, and no paper soiling was observed. SAMPLE #20 showed a sharper halftone than SAMPLE #15.

However, gray soiling was observed for SAMPLE #20 after fixing. The soiling was caused by the fact that some of the toner moves from the print paper to the fixing roller during fixing and then moves back onto the print paper after one complete rotation of the fixing roller. Such a phenomenon is due to the fact that too large an amount of the external additive added to the gray toner was detrimental to the fusing of the toner into the print paper.

COMPARISON #11

Halftone printing was performed using TONER #1 as a black toner and TONER #35 as a gray toner, thereby obtaining SAMPLE #21. Table 28 shows the print quality of SAMPLEs #15 and #21 evaluated by inspection. No difference in paper soiling between SAMPLE #15 and SAMPLE #20 was observed, and no soiling was observed. Insufficient fixing result was observed neither in SAMPLE #15 and nor in SAMPLE #20.

However, the halftone images had more graininess in SAMPLE #21 than in SAMPLE #15. Continuous printing causes the external additive to be in the sea of base toner particles or to become detached from the toner particles, impairing flowability of the toner particles.

EXAMPLE #14

Halftone printing was performed using TONER #26 as a black toner and TONER #30 as a gray toner, thereby obtaining SAMPLE #22. Likewise, printing was performed using TONER #26 as a black toner and TONER #33 as a gray toner, thereby obtaining SAMPLE #23.

Table 28 shows the results of SAMPLEs #22 and #23 evaluated by inspection. Paper soiling was observed, i.e., insufficient fixing result was observed neither in SAMPLEs #22 nor in SAMPLE #23. As to faintness (カスレ) of the printed image, slight graininess was observed in printed gray areas of SAMPLE #22, having low print duties. Observation under a loupe revealed that a low print duty part of SAMPLE #22 had incompletely-shaped dots of halftone due to missing of some portions of the respective dots.

COMPARISON #12

Halftone printing was performed using TONER #26 as a black toner and TONER #34 as a gray toner, thereby obtaining SAMPLE #24. Table 28 shows the quality of SAMPLEs #22 and #24 evaluated by inspection. No paper soiling was observed in SAMPLEs #22 and #24. SAMPLE #24 had a sharper halftone than SAMPLE #22.

However, SAMPLE #24 was soiled with the gray toner after fixing. The soiling was caused by the fact that some of the toner moves from the print paper to the fixing roller during fixing and then moves back onto the print paper after one complete rotation of the fixing roller. Such a phenomenon is due to the fact that too large an amount of the external additive added to the gray toner is detrimental to the fusing of the toner into the print paper.

EXAMPLE #15

Halftone printing was performed using TONER #29 as a black toner and TONER #35 as a gray toner, thereby obtaining SAMPLE 25. Likewise, printing was performed using TONER #29 as a black toner and TONER #7 as a gray toner, thereby obtaining SAMPLE #26.

Table 28 shows the quality of SAMPLEs #25 and #26. No difference in paper soiling between SAMPLE #25 and SAMPLE #26 was observed. As for faintness of the printed image, slight graininess was observed in image portions having low print duties of SAMPLE #25 printed with gray toner. Observation under a loupe revealed that a low print density part of SAMPLE #25 had dots of halftone incomplete due to missing of some portions of the respective dots.

The first to third embodiments have been described in terms of an image forming apparatus having a function of a printer. The present invention is not limited to an image forming apparatus, and may be applicable to facsimile machines, copying machines, and multi function peripherals.

The invention being thus described, it will be obvious that the same may be varied in many ways. Such variations are not to be regarded as a departure from the scope of the invention, and all such modifications as would be obvious to one skilled in the art intended to be included within the scope of the following claims.

What is claimed is:

1. An image forming apparatus including a plurality of developing devices each of which performs an electrophotographic process to form an image, the image forming apparatus comprising;

a first developing device that holds a black developer containing a first black coloring agent; and a second developing device that holds a gray developer, the gray developer containing a second black coloring agent and a coloring agent of a chromatic color, the chromatic color being a complementary color to the second black coloring agent.

2. The image forming apparatus according to claim 1, wherein the coloring agent of the chromatic color is smaller in amount than the first black coloring agent.

3. The image forming apparatus according to claim 1, wherein said second developing device comprises a plurality of second developing devices that hold corresponding gray developers, each of the gray developers being different in toner density from the other gray developers.

4. The image forming apparatus according to claim 1, wherein an image printed using the gray developer includes a density in a range of 0.212 to 0.506 of that of an image printed using the black developer.

5. The image forming apparatus according to claim 1, wherein an image printed using the gray developer and having a print duty of 100% includes a saturation ΔEab in a L*a*b* color space, the saturation being given by $$\Delta Eab=\{(a^*)^2+(b^*)^2\}^{1/2}\leqq 5$$

where ΔEab is saturation, L* is lightness value, a* is a redness-greenness value, and b* is a yellowness-blueness value.

6. The image forming apparatus according to claim 1, wherein the gray developer includes a smaller particle diameter than the first black developer.

7. The image forming apparatus according to claim 1, wherein the gray developer includes a particle diameter in a range of 0.7 to 0.9 of that of the first black developer.

8. The image forming apparatus according to claim 1, wherein the black developer and the gray developer include base particles formed of binding resin containing at least a coloring agent and an external additive added to surfaces of the base particles, the gray developer including a larger amount of the external additive than the black developer.

9. The image forming apparatus according to claim 8, wherein an amount of the external additive added to the gray developer is in a range of 1.1 to 1.3 of that added to the back developer.

10. The image forming apparatus according to claim 8, wherein the external additive is an inorganic fine powder.

11. The image forming apparatus according to claim 10, wherein the inorganic fine powder is silica.

12. The image forming apparatus according to claim 1, wherein one of the first black coloring agent and the second black coloring agent is carbon black.

13. The image forming apparatus according to claim 1, wherein the coloring agent of the chromatic color is blue.

14. The image forming apparatus according to claim 1, wherein the coloring agent of the chromatic color in mass parts is in a range of 0.050 to 0.400 of that of the second black coloring agent.

15. The image forming apparatus according to claim 1, wherein each developer is a toner.

16. The image forming apparatus according to claim 15, wherein each developer is held in a toner cartridge.

17. The image forming apparatus according to claim 1, wherein the black developer and the gray developer are selectively used in accordance with a print duty of an image that should be printed.

18. The image forming apparatus according to claim 1, wherein the black developer and the gray developer are selectively used in accordance with a print density of an image that should be printed.

19. A method of forming an image by operating a plurality of developing devices each of which performs an electrophotographic process to form an image, the method comprises:

preparing a first developing device that holds a first developer containing a first black coloring agent;

preparing a second developer device that holds a second developer containing a second black coloring agent and a coloring agent of a chromatic color, the coloring agent of the chromatic color being complementary to a shade of the second black coloring agent;

printing a first portion of an image by operating the first developing device in accordance with a first range of print duty of the image; and printing a second portion of the image by operating the second developing device in accordance with a second range of print duty of the image.

20. The method according to claim 19, wherein the first range of print duty includes a print duty from 80 to 100% and the second range of print duty includes a print duty from 10 to 70%.

* * * * *